US005666191A

United States Patent [19]

Hasegawa et al.

[11] Patent Number: 5,666,191

[45] Date of Patent: Sep. 9, 1997

[54] SHEET PRINTD INFORMATION OBLITERATING DEVICE

[75] Inventors: Takanori Hasegawa; Noboru Inamine, both of Ninato-ku, Japan

[73] Assignee: Riso Kagaku Corporation, Tokyo, Japan

[21] Appl. No.: 25,764

[22] Filed: Mar. 3, 1993

[30] Foreign Application Priority Data

Mar. 5, 1992 [JP] Japan ..... 4-048814
Mar. 5, 1992 [JP] Japan ..... 4-048815

[51] Int. Cl.[6] ..... G03G 21/04

[52] U.S. Cl. ..... 399/366; 283/902; 358/401

[58] Field of Search ..... 355/201, 202, 355/313; 101/490, 219; 281/2, 5; 283/901, 902, 73, 17; 380/54, 55; 379/100; 178/37; 358/401, 474

[56] References Cited

U.S. PATENT DOCUMENTS 4,573,409 3/1986 Clar et al. ..... 101/490
4,786,941 11/1988 Regan ..... 355/201
4,980,719 12/1990 Allen et al. ..... 355/201
5,095,816 3/1992 Hasegawa et al. ..... 101/119
5,163,088 11/1992 LoCascio ..... 379/100 X
5,303,070 4/1994 Christ ..... 358/474
5,465,160 11/1995 Kamo et al. ..... 358/401

FOREIGN PATENT DOCUMENTS 1-072265 3/1989 Japan .
WO-A-8402108 6/1984 WIPO .

*Primary Examiner*—Shuk Yin Lee
*Attorney, Agent, or Firm*—Dickstein Shapiro Morin & Oshinsky LLP

[57] ABSTRACT

A device for obliterating printed information on a sheet utilizes an information concealing printing unit for printing an information concealing pattern over a surface of a sheet carrying printed information. On printing the information concealing pattern over the surface of the sheet carrying the printed information, the printed information becomes unreadable. Various types of printing devices may be used and the printed information which is obliterated may be first recorded in electronic format for later retrieval.

13 Claims, 18 Drawing Sheets

FIG. 5

```
file list

1. 92-01-10  10:00  reports       5 pages
2. 92-01-11  15:00  instructions  1 page
```

storage medium driver
185
183
line image sensor unit
117
A/D converter
175
correction unit
177
read image data storage unit
179
111
information concealing pattern generating unit
181
thermal head
123
drive unit
113
189
information concealing pattern storage unit
187
mode setup unit
167
173
control unit
171
plate ejection unit
163
paper feed unit
143
printer unit
115

SHEET PRINTD INFORMATION OBLITERATING DEVICE

TECHNICAL FIELD

The present invention relates to a sheet printed information obliterating device, and in particular to a sheet printed information obliterating device for disposing of paper and other sheets for information security purposes.

BACKGROUND OF THE INVENTION

The device for finely shredding paper which is generally called "shredder" is widely used as a sheet printed information obliterating device for preventing the information printed on paper sheets from being leaked by rendering the information printed on the paper sheets unreadable.

Since such a sheet printed information obliterating device based on the principle of shredding paper employs a rotary cutter rotating at high speed for shredding paper, and therefore produces a relatively high noise level, it may not be suitable for use in offices where excessive noises are not tolerated.

Furthermore, since the paper is shredded into fine strips of paper, and is simply dropped into a shredded paper storage box or the like in a highly random fashion, the resulting pile of shredded paper strips is so bulky that the handling of the shredded paper is not easy, and a considerable space and much efforts are required for its disposal.

Also, the paper fibers are so finely shredded that they are no more suitable for recycling, and this is detrimental to the efforts to utilize existing resources.

The shredder ensures prevention of information leakage by finely shredding the paper sheets and rendering the information printed on the paper sheets to be unreadable, but, obviously, is not capable of restoring the shredded paper sheets to their original condition or to reproduce the obliterated information.

BRIEF SUMMARY OF THE INVENTION

In view of such problems of the prior art, a primary object of the present invention is to provide a sheet printed information obliterating device which can render the information practicaly unreadable while allowing easy handling of the processed sheets of paper or the like.

A second object of the present invention is to provide a sheet printed information obliterating device which requires relatively small space and little efforts for the processed or disposing sheets of paper or the like.

A third object of the present invention is to provide a sheet printed information obliterating device which allows the processed sheets to be recycled for better utilization of existing resources.

A fourth object of the present invention is to provide a sheet printed information obliterating device which is capable of storing the information printed on the sheets so that it may be reproduced when required.

According to the present invention, these and other objects of the presenty invention can be accomplished by providing a sheet printed information obliterating device, comprising information concealing printing means for printing an information concealing pattern over a surface of a sheet carrying printed information.

According to such a structure, the information concealing printing means prints the information concealing pattern over the surface of the sheet carrying the printed information, and thereby renders the printed information unreadable by virtue of the information concealing pattern written over the printed information. Thus, because the resulting processed sheets are not physically shredded, and, in the case of paper sheet, the fibers are not finely severed, the processed sheets can be easily handled without requiring any large space or any substantial efforts for the handling, and the processed sheets can be recycled for better utilization of existing resources.

According to a preferred embodiment of the present invention, the sheet printed information obliterating device further comprises information reading means for reading information printed on the information carrying surface of the sheet before printing the information concealing pattern over the information carrying surface of the sheet; and information storage means for retrievably storing data on the information read by the information reading means, so that if the information obliterated by the present invention is later needed to be reproduced, it can be reproduced from the information storage means. Therefore, it is possible to avoid inadvertent irrevocably destroying information by the information obliterating device of the present invention. The information stored in the information storage means may be kept in suitable storage media, but may also be erased when it has become certain that the reproduction of any part of the stored information stored is not necessary.

Typically, the sheet printed information obliterating device further comprises information concealing pattern storage means; and printed image forming unit for generating the information concealing pattern according to information concealing pattern data stored in the information concealing pattern storage means.

The information concealing pattern storage means may comprise means for substantially permanently storing the information concealing pattern, such as ROM, so that a single information concealing pattern may be used at all times, or one from a plurality of information concealing patterns may be selectively used according to externally given commands, for instance according to the selection made by the user.

The optimum information concealing pattern may well depend on the kind of the printed information to be obliterated. Therefore, according to a preferred embodiment of the present invention, the sheet printed information obliterating device according to the present invention may further comprise original reading means for reading image from the image carrying surface of the sheet from which information is to be obliterated; and information concealing pattern generating means for generating an information concealing pattern according to the image read by the original reading means, and supplying the information concealing pattern to the information concealing printing means. The factors which determines the optimum information concealing pattern may include the kind of the letters or characters expressing the information, the character pitch, the line spacing, and the arrangement of the printed pattern.

According to another embodiment of the present invention, the sheet printed information obliterating device according to the present invention may be conveniently incorporated with a printer serving as an output unit of a computer, or a copier, in particular a digital copier which electronically reads an original image and duplicates such an image according to the electronic data obtained by electronically reading the original. By doing so, the capability of the printer or the copier to form images can be used for the dual purposes of obliterating information by covering it up with another image and printing information supplied from a computer or an optical scanner.

For instance, the sheet printed information obliterating device of the present invention may further comprise mode setting means for selectively setting an information concealing mode, and normal print image storage means for storing images for normal printing purpose, the information concealing printing means printing the information concealing pattern on the information carrying surface of the sheet when the information concealing mode is set up by the mode setting means, and printing normal print images on a surface of a sheet when a mode different from the information concealing mode is set up by the mode setting means.

In this case, the images for normal printing purpose can therefore be derived either from substantially permanent data storage means or from images obtained by image scanning means.

BRIEF DESCRIPTION OF THE DRAWINGS

Now the present invention is described in the following with reference to the appended drawings, in which:

FIG. 5 is an illustrative view of an example of file list display in the sheet printed information obliterating device according to the present invention;

DETAILED DESCRIPTION OF THE PREFERRED EMBODIMENTS

Figure 1:
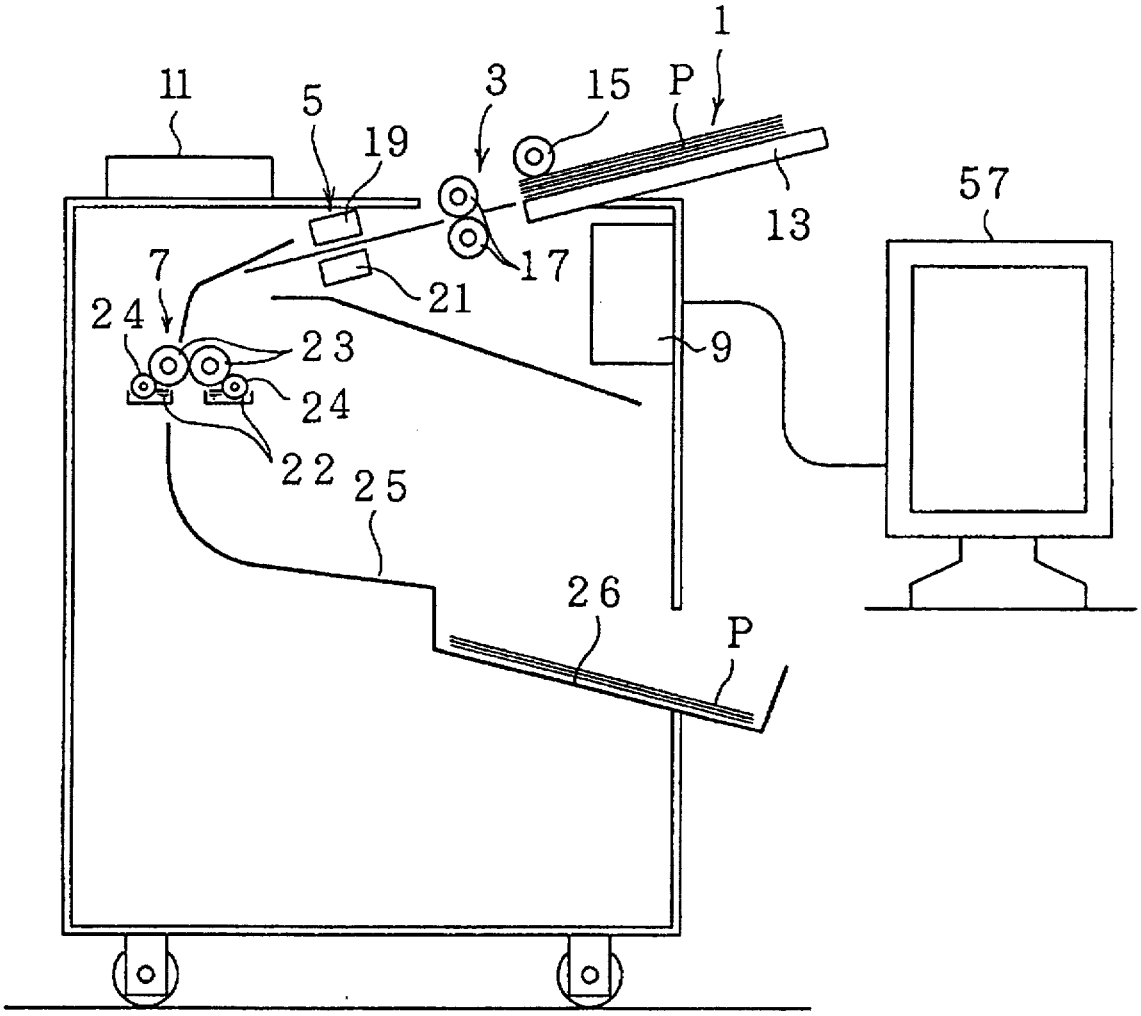
FIG. 1 is a schematic structural view of a first embodiment of the sheet printed information obliterating device according to the present invention.

FIG. 1 shows a first embodiment of the sheet printed information obliterating device according to the present invention. This sheet printed information obliterating device comprises an automatic paper feed unit 1, a paper feed roller unit 3, an information reading unit 5, an information concealing printing unit 7, an information processing unit 9, and an operation panel unit 11.

The automatic paper feed unit 1 is adapted to feed paper sheets P placed on a paper feed table 13 to the paper feed roller unit 3 sheet by sheet by means of a feed roller 15.

The paper feed roller unit 3 comprises a pair of paper feed rollers 17 which feed the paper sheets P supplied from the automatic paper feed unit 1 to the information reading unit 5 at a prescribed feed speed.

The information reading unit 5 comprises a CCD line sensor 19 for reading the front side of the paper sheet serving as first information reading means, and a CCD line sensor 21 for reading the reverse side of the paper sheet serving as second information reading means. The CCD line sensor 19 for the front side is secured to a position suitable for reading the information printed on the front side or the upper side (in the illustrated embodiment) of the paper sheet P fed from the paper feed roller unit 3 while the CCD line sensor 21 for the reverse side is secured to a position suitable for reading the information printed on the reverse side or the lower side (in the illustrated embodiment) of the paper sheet P fed from the paper feed roller unit 3.

The information concealing printing unit 7 is placed downstream of the information reading unit 5 as seen in the direction of feeding the paper sheets P by the paper feed roller unit 3, and receives the paper sheets P which have been passed through the information reading unit 5. The information concealing printing unit 7 comprises a pair of printing rollers 23 each carrying an information concealing pattern and rotatively driven by a motor not shown in the drawing, and a pair of ink applicator rollers 24 for supplying printing ink from ink supply sources 22 to the corresponding printing rollers 23 so that the information concealing pattern may be printed on both the front and reverse sides of each of the paper sheets P passed between the printing rollers 23.

The information concealing pattern of the information concealing printing unit 7 may consist of any pattern suitable for concealing the information expressed by the characters, letters and other symbols printed on the paper sheet P such as a solid dark pattern, a halftone pattern, a fine geometric pattern, an irregular pattern, an irregular stripe pattern or characters or letters including a large number of lines, and of a size similar to the letter or the symbol to be concealed, which are arranged at a fine character pitch and at a small line spacing. The optimum information concealing pattern may vary depending on the way the information is printed on the paper sheet, the printing material such as ink or the toner, and other factors, but irregular stripe patterns and character patterns generally produce good results. The characters or letters which may be used as the information concealing pattern are preferred to be of the same kinds as the carrier of the information. For instance, when the information to be concealed is expressed in Japanese, Japanese characters and letters or, in other words, katakanas, hiraganas, and kanjis are preferred. When the information to be concealed is expressed in English, Roman letters are preferred as the patterns for concealing the information. The information concealing pattern may consist of a repetition of a same letter or may consist of a periodic or irregular repetition of a plurality of letters, or may even consist of letters forming meaningful sentences.

Below the information concealing printing unit 7 are placed an ejection guide passage 25 for the paper sheets P, and a paper sheet stacking table 26 for receiving and stacking up the processed paper sheets P.

Figure 2:
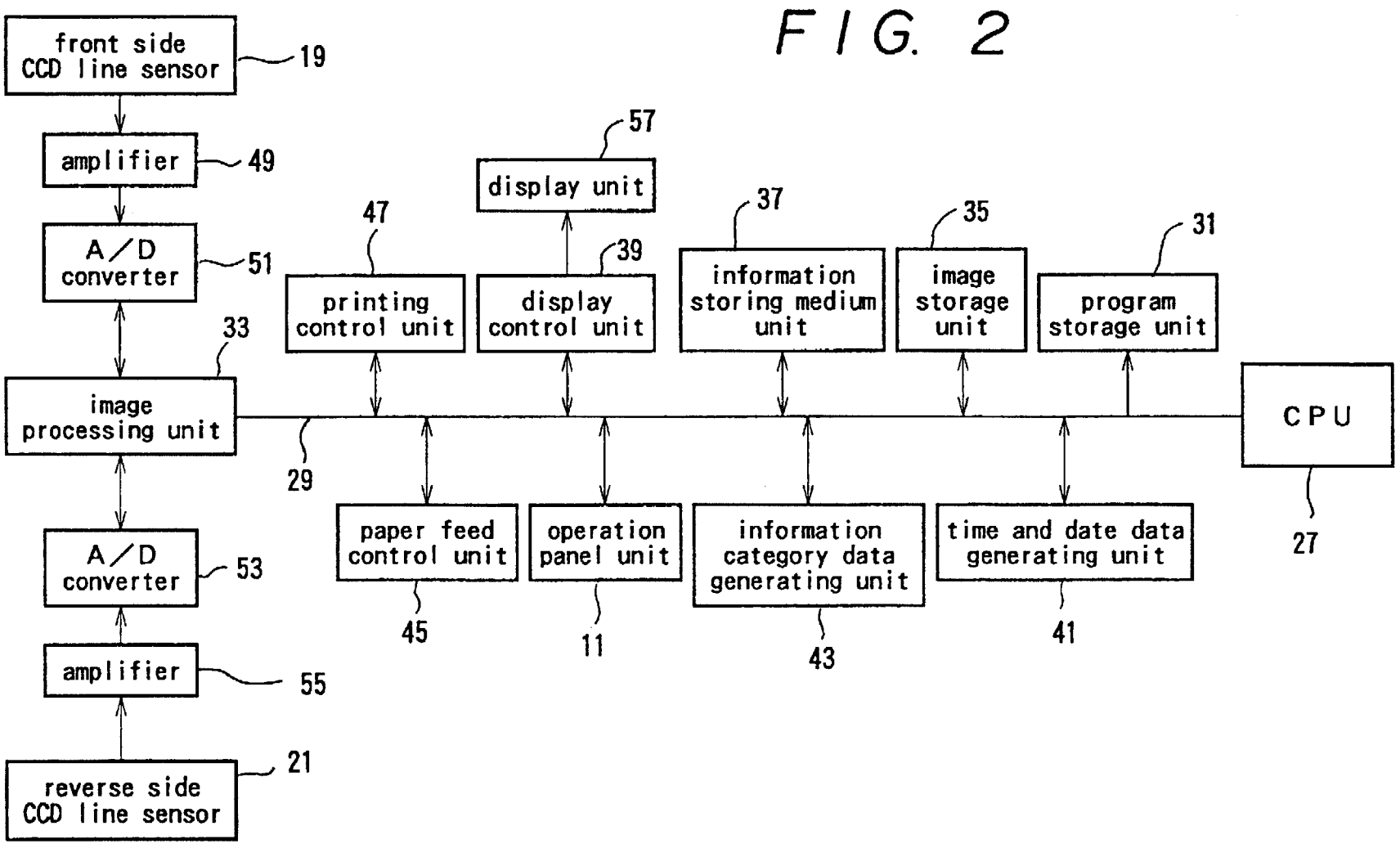
FIG. 2 is a block diagram of the control system for the sheet printed information obliterating device shown in FIG. 1.

As illustrated in FIG. 2, the information processing unit 7 consists of a computer including a CPU 27, and comprises a program storage unit 31, an image processing unit 33, an image storage unit 35, an image storing medium unit 37, a display control unit 39, a time and date data generating unit 41, an information category data Generating unit 43, a paper feed control unit 45 for controlling the operation of the automatic paper feed unit 1, and a printing control unit 47 for controlling the operation of the information concealing printing unit 7, which are connected to one another by a bus line 29. The bus line 29 is also electrically connected to the operation panel unit 11.

The CCD line sensor 19 for the front side and the CCD line sensor 21 for the reverse side read the information printed on the paper sheet P as images, and convert them into electric signals. The electric signal produced from the CCD line sensor 19 for the front side is amplified by an amplifier 49, and is converted into a digital signal by an A/D converter 51, while the electric signal produced from the CCD line sensor 21 for the reverse side is amplified by an amplifier 53, and is converted into a digital signal by an A/D converter 55. These digital signals are supplied to the image processing unit 33.

The image processing unit 33 carries out a correction process and a compression process on the digital signals from the A/D converters 49 and 53 according to the command from the CPU 27, and stores the processed signals as image data in the image storage unit 35 for each of the paper sheets P.

The image storage unit 35 is a buffer memory for storing image data corresponding to one sheet of paper P, and includes a memory area for the data read out by the CCD line sensor 19 for the front side or for the information read out from the front side of the paper sheet, and another memory area for the data read out by the CCD line sensor 21 for the reverse side or for the information read out from the reverse side of the paper sheet. When image data corresponding to one sheet of paper is stored in either one of the memory areas or both of the memory areas, this image data is transferred to the information storing medium unit 37 by the command from the CPU 27.

The information storing medium unit 37 is an external storage unit which can store image data as files in such storage media as an optical disk, a floppy disk, a hard disk and a magnetic tape. The files may be automatically assigned with serial numbers in the order of creation for the convenience of designating them when reading them out.

The display control unit 39 carries out the control action for displaying the information on read out data for the purpose of checking the contents of the read out data, and displaying the information on the read out data for the purpose of reproducing the image data stored in the information storing medium unit 37, and is connected to a display 57 such as a CRT unit.

The time and date data generating unit 41 consists of a calendar/timer for generating data on the current time and date by the command from the CPU 27, and the data on the current time and date generated by the time and date data generating unit 41 is automatically assigned to the file which is stored in the information storing medium unit 37 according to the read out image data as a time stamp including data on the time and date of the creation of the file.

Figure 3:
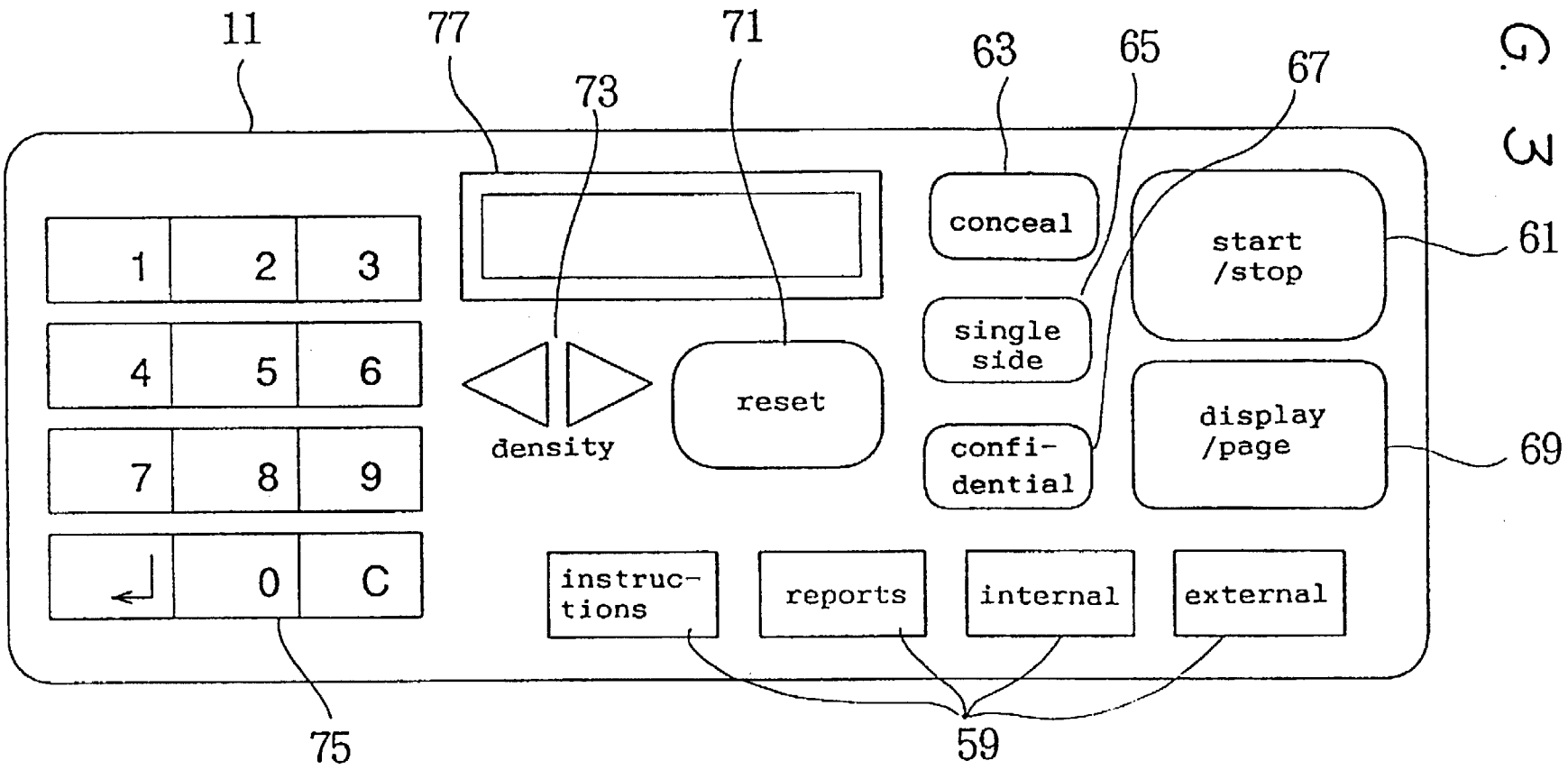
FIG. 3 is a plan view of the operation panel for the sheet printed information obliterating device shown in FIG. 1.

The information category data generating unit 43 stores different codes for various categories of documents produced during the normal course of business, such as "report", "instruction", "internal data" and "external data", and selects one of the categories according to the manual operation of the category selection key 59 of the operation panel 11 which is illustrated in FIG. 3. The data on the selected category is also automatically assigned as a label to each of the files when it is stored, along with the data on the time and date of the creation of the file as a process of executing a program.

As illustrated in FIG. 3, in addition to the category selection key 59, the operation panel 11 is provided with a start/stop key 61, an information concealing mode selection key 63, a single side selection key 65, a confidential mode selection key 67, a display mode selection/next page key 69, a reset key 71 for resetting various items of selection, a density adjustment key 73 for adjusting the density according to the condition of the printed information to be read, a ten-key pad 75 for entering password numbers when the confidential mode is selected and designating the file to be reproduced, and a LCD panel 77 for checking the contents of the selections made, and the signals from these keys are supplied to the information processing unit 9.

Now the operation of the sheet printed information obliterating device having the above described structure is described in the following. According to this sheet printed information obliterating device, when the electric power is turned on, a double side selection mode for storing the data of the both sides of each paper sheet is automatically selected as a default mode. A stack of paper sheets P to be disposed of is placed on the paper feed table 13 of the automatic paper feed unit 1 with the first page placed on the top of the stack, and, after pressing the category selection key 59 according to the category of the paper sheets to be disposed of if necessary, the start/stop key 61 is pressed.

Then, the paper sheets P stacked on the paper feed table 13 are fed to the paper feed roller unit 3 sheet by sheet, and are then fed to the information reading unit 5 by the paper feed roller unit 3 again sheet by sheet at a prescribed speed.

At this time, the CCD line sensor 19 for the front side and the CCD line sensor 21 for the reverse side are both ready for reading information from each paper sheet. The CCD line sensor 19 for the front side reads the front side or the upper surface (as seen in FIG. 1) of each paper sheet P which passes through at a prescribed speed in front of the CCD line sensor 19 (as seen in FIG. 1) to obtain image information, and converts it into an electric signal. The CCD line sensor 21 for the reverse side likewise reads the reverse side or the lower surface (as seen in FIG. 1) of each paper sheet P which passes through at a prescribed speed in front of the CCD line sensor 21 (as seen in FIG. 1) to obtain image information, and converts it into an electric signal. Thus, the two sides of each paper sheet are read.

The electric signal produced from the front side CCD line sensor 19 is amplified by the amplifier 49, and is converted into a digital image signal by the A/D converter 51, and the electric signal produced from the reverse side CCD line sensor 21 is likewise amplified by the amplifier 55, and is converted into a digital image signal by the A/D converter 53. These digital image signals are transferred to the image processing unit 33, and are subjected to a correction process and a compression process therein. These digital image signals are then stored in the image storage unit 35 as image data for each paper sheet P.

In the image storage unit 35, when the image data of each paper sheet P is written into the memory areas separately for the front side and the reverse side, the image data is transferred to the information storing medium unit 37 separately for the front side and the reverse side and again separately written into the storing medium in a prescribed order.

When the front side or the reverse side of the paper sheet P is totally blank, and the corresponding image data entirely consists of white data, the image data of this page is not needed to be transferred to the image storing medium unit 37, and this fact is transferred to the information storing medium unit 37 to be recorded therein as a remark.

The process of writing image data into the storage medium of the information storage medium unit 37 is carried out in such a manner that each stack of paper sheets may be grouped into a single file, and each file is assigned with a serial number in the order of creation, data on the time and date of creation generated by the date data generating unit 41, and category data generated by the category data generating unit 43. Such data is also retriveably written into the storing medium of the information storing medium unit 37 along with the image data itself.

After being passed through the image reading unit 5 to have information read therefrom, each paper sheet P is fed into the information concealing printing unit 7 where the paper sheet P is fed into the nip between the printing rollers 23, and the two sides of the paper sheet are printed with image concealing patterns over the information already printed on the paper sheet. As a result, the information concealing patterns are written over the information already printed on the paper sheet, and make it totally unreadable.

Figure 4:
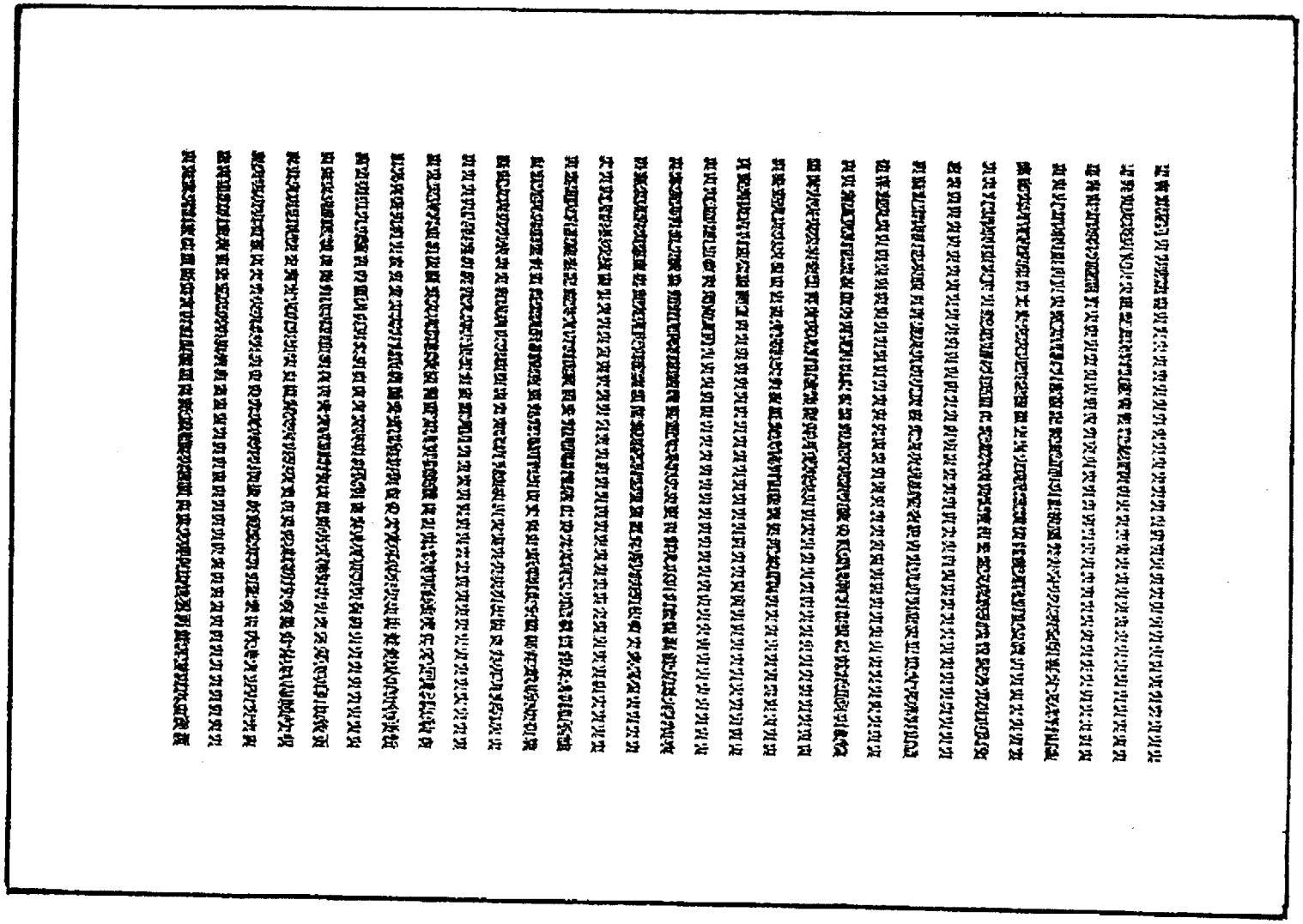
FIG. 4 is an illustrative view of an actual example of result of printing an information concealing pattern over an information carrying surface of a paper sheet.

FIG. 4 shows an actual example showing how the information already printed on a paper sheet P can be obliterated and made unreadable by printing an information concealing pattern thereover. The kanji "ura (meaning "reverse" and having a relatively large number of lines therein)" is printed all over the first page of this application, and this clearly shows how the information already printed on a sheet of paper can be made unreadable by printing an information concealing pattern thereover.

The paper sheet whose printed information is thus made unreadable or the paper sheet to be disposed of is fed to the paper stack table 26 guided by the eject guide passage 25, and is stacked upon the paper stack table 26. Thus, the paper sheets to be disposed of can be conveniently handled and collected for discarding or recycling without taking up excessive space.

When confidentiality is required when disposing of the paper sheets P as described above, the confidential mode selection key 67 should be pressed before pressing the start/stop key 61. In this case, the confidential mode is selected, and the system waits for a password to be entered. The password is entered as a certain number of digits entered from the ten-key pad 75, and pressing of the start/stop key 61 following the entry of the password places the system ready for reading information.

When only one side (the front side) of each paper sheet is needed to be read, the single side mode selection key 65 should be pressed before pressing the start/stop key 61. In this case, the single side storage mode is selected, and only the front side CCD line sensor 19 is activated for reading information.

When there is no need to store the information printed on the paper sheets P, the information concealing mode selection key 63 should be pressed before pressing the start/stop key 61. In this case, both the front side CCD line sensor 19 and the reverse side CCD line sensor 21 are deactivated, and the paper sheets P are directly fed into the information concealing printing unit 7 to be printed over with the information concealing pattern without any information being read therefrom.

When the image information data stored as a file in the recording medium of the information storing medium unit 37 for each group of paper sheets is desired to be reproduced and displayed, the display mode selection/next page key should be pressed. This allows the display mode for the image data to be set up, and a list of the files stored in the storing medium of the information storing medium unit 37 is displayed on the display unit 57 as illustrated in FIG. 5. This list includes only those not assigned with the passwords for confidentiality, and for such files to be included in the list it is necessary to press the confidential mode selection key 67 and enter the corresponding password from the ten-key pad 75. Only when the entered password matches with that assigned to the files in question, these files are included in the list of files displayed on the display unit 57.

The display of the file list includes a serial number, time and data of creation, a category, and a number of pages for each of the files, and a file desired to be displayed can be designated by entering the corresponding serial number.

When the corresponding file serial number is entered from the ten-key pad 75, and a file is designated to be displayed, the designated file is read out from the storing medium of the information storing medium unit 37, and is displayed on the display unit 57 page by page. If the image information covers both the front and reverse sides of each paper sheet, the display on the display unit 57 may be split into two windows for showing the front and reverse sides of the paper sheet at the same time, or, alternatively, each side may be displayed on the display unit 57 one at a time.

Figure 6:
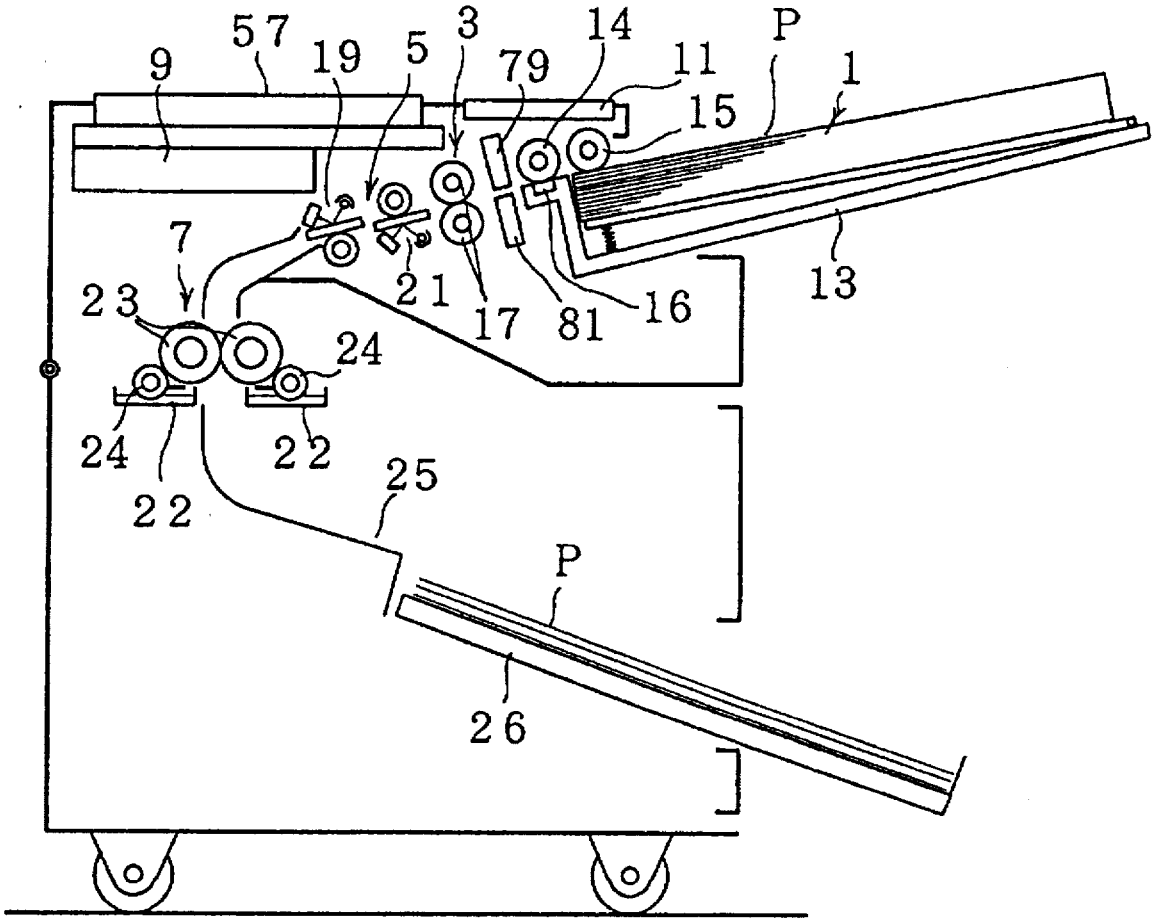
FIG. 6 is a schematic structural view of a second embodiment of the sheet printed information obliterating device according to the present invention.

FIG. 6 shows a second embodiment of the sheet printed information obliterating device according to the present invention. In FIG. 6, the parts corresponding to those of the previous embodiments are denoted with like numerals as those used in FIG. 1.

In the embodiment illustrated in FIG. 6, a paper separating roller 14 and a friction pad member 16 are arranged opposite to each other at an outlet end of the automatic paper feed unit 1 so that even when two sheets of paper P are inadvertently fed out onto the paper feed table 13 at the same time the lower paper sheet may be prevented from being fed out and only the upper paper sheet may be fed out by virtue of the difference between the friction between the paper separation roller 14 and the paper sheet P and the friction between the friction pad member 16 and the paper sheet P.

A laterally central part of the outlet end of the automatic paper feed unit 1 is provided with a light emitting device 79 and a light receiving device 81 above and below a feed out passage for the paper sheets, respectively, so that the count of the paper sheets fed out may be made, and the occurrence of double feeding may be thereby detected by making use of the fact that the amount of light received by the light receiving device 81 changes each time a paper sheet passes between the light emitting device 79 and the light receiving device 81 and obstructs the passage of light therebetween.

Detection of double feeding or the feeding of two or more sheets of paper at the same time based on the change in the amount of light received by the light receiving device 81 can be made by evaluating the amount of light transmitted through the paper sheet or the paper sheets which differs depending on the number of paper sheets the light has passed through. Thus, a detection circuit unit for the light receiving device 81 has a certain threshold level corresponding to the amount of light which passes through a single sheet of paper stored therein so that the occurrence of double feeding may be detected when the amount of light received by the light receiving device falls below this threshold level. When an occurrence of double feeding is detected, the feeding of the paper sheets P is interrupted, and an error processing routine including a visual error display and a sound alarm is executed.

Figure 7:
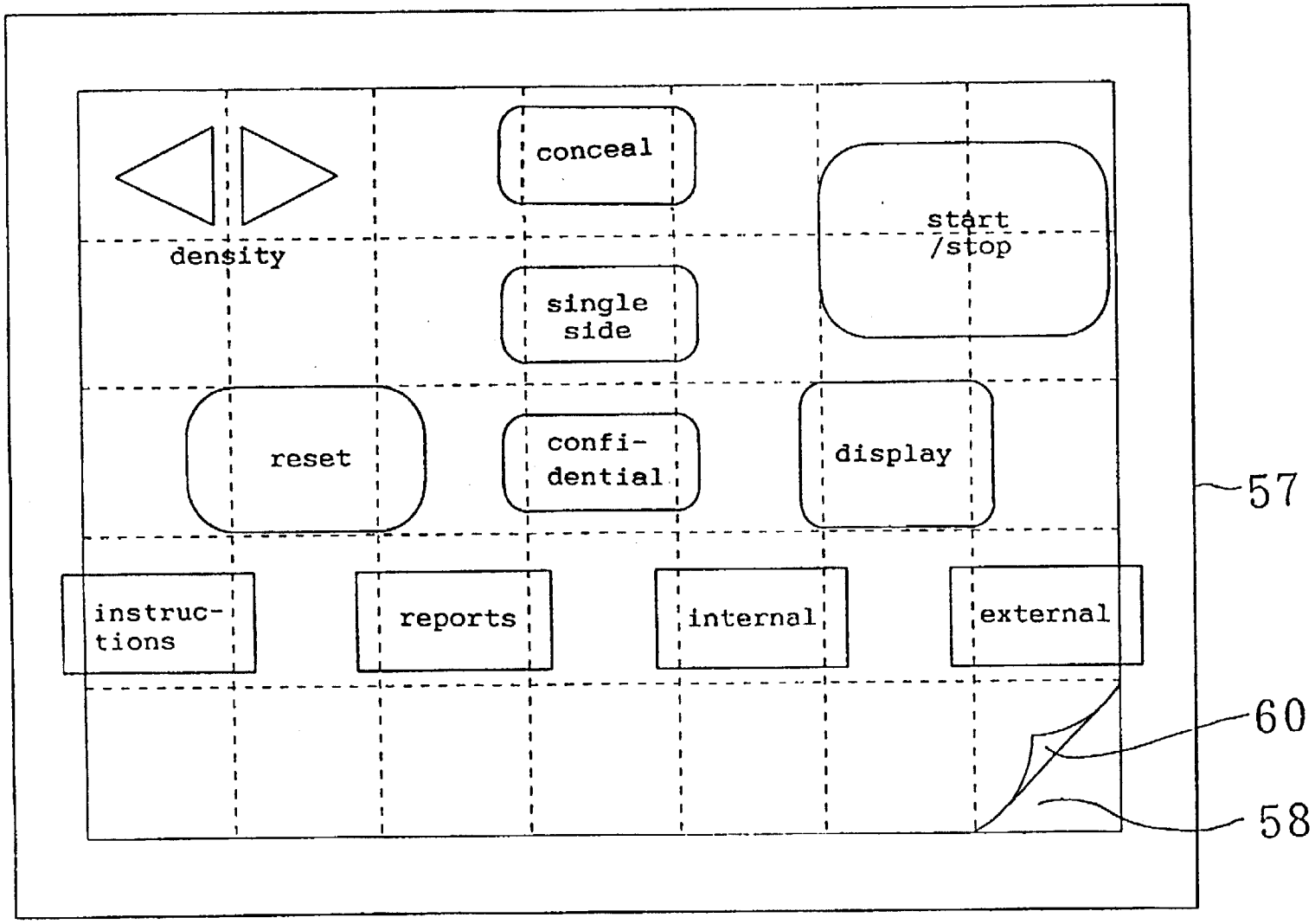
FIG. 7 is a plan view of the display unit for the sheet printed information obliterating device shown in FIG. 6.

In the embodiment illustrated in FIG. 6, the display unit 57 is integrally mounted on the upper surface of the cabinet for the sheet printed information obliterating device. The display unit 57 comprises a liquid crystal display panel 58 as illustrated in FIG. 7, and a transparent touch panel 60 is placed over the surface of the LCD panel 58. In this embodiment, as illustrated in FIG. 7, various keys are displayed on the LCD panel 58, and various modes, functions and items can be selected by simply touching the corresponding regions of the touch panel 60. In this case, the operation panel 11 may be omitted.

Figure 8:
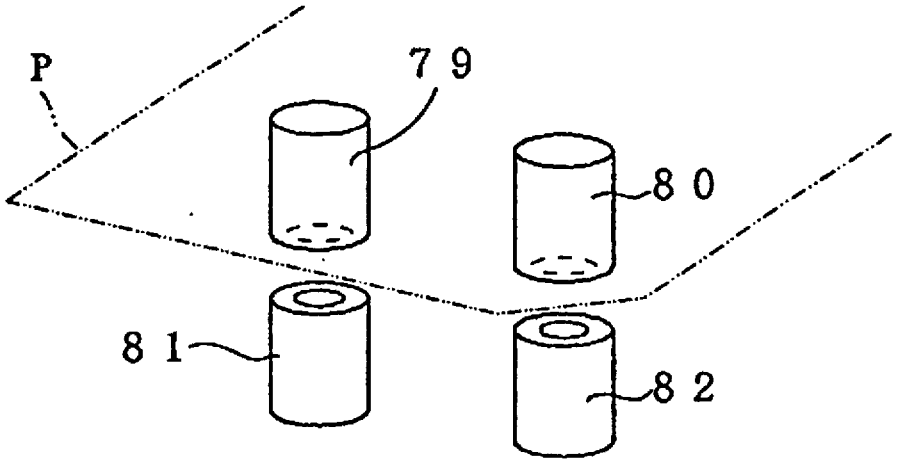
FIG. 8 is a fragmentary plan view of an essential part of a third embodiment of the sheet printed information obliterating device according to the present invention.

FIG. 8 shows an essential part of a third embodiment of the sheet printed information obliterating device according to the present invention. In this embodiment, another pair of a light emitting device 80 and a light receiving device 82 are placed above and below the feed passage of the paper sheets P on one side of the pair of the light emitting device 79 and the light receiving device 81. The position of the second pair of light emitting device 80 and the light receiving device 82 corresponds to a side edge of the paper sheet during its feeding movement as illustrated in the drawing, and the light from the light emitting device 80 can reach the light receiving device 82 without being obstructed when a corner of the leading edge of the paper sheet is cut off in a triangular shape.

Thus, according to the combination of the change in the amount of light received by the light receiving device 80 and the amount of light received by the other light receiving device 82, it is possible to determined if the corner of the leading edge of each paper sheet is cut off in a triangular shape or not. Thereby, it is possible to select specific sheets of paper from the paper sheets P stacked up on the paper feed table 13, and activate the information reading unit 5 only for those thus selected. Thus, it is possible to automatically select specific sheets from a group of paper sheets and store only the information printed on the selected sheets of paper.

Selective storing of information printed on specific sheets of paper can be carried out also by marking a certain part of each of the selected sheets of paper, and selectively activating the information storing unit only for those from which the presence of such a mark is detected by the information reading unit 5.

Figure 9:
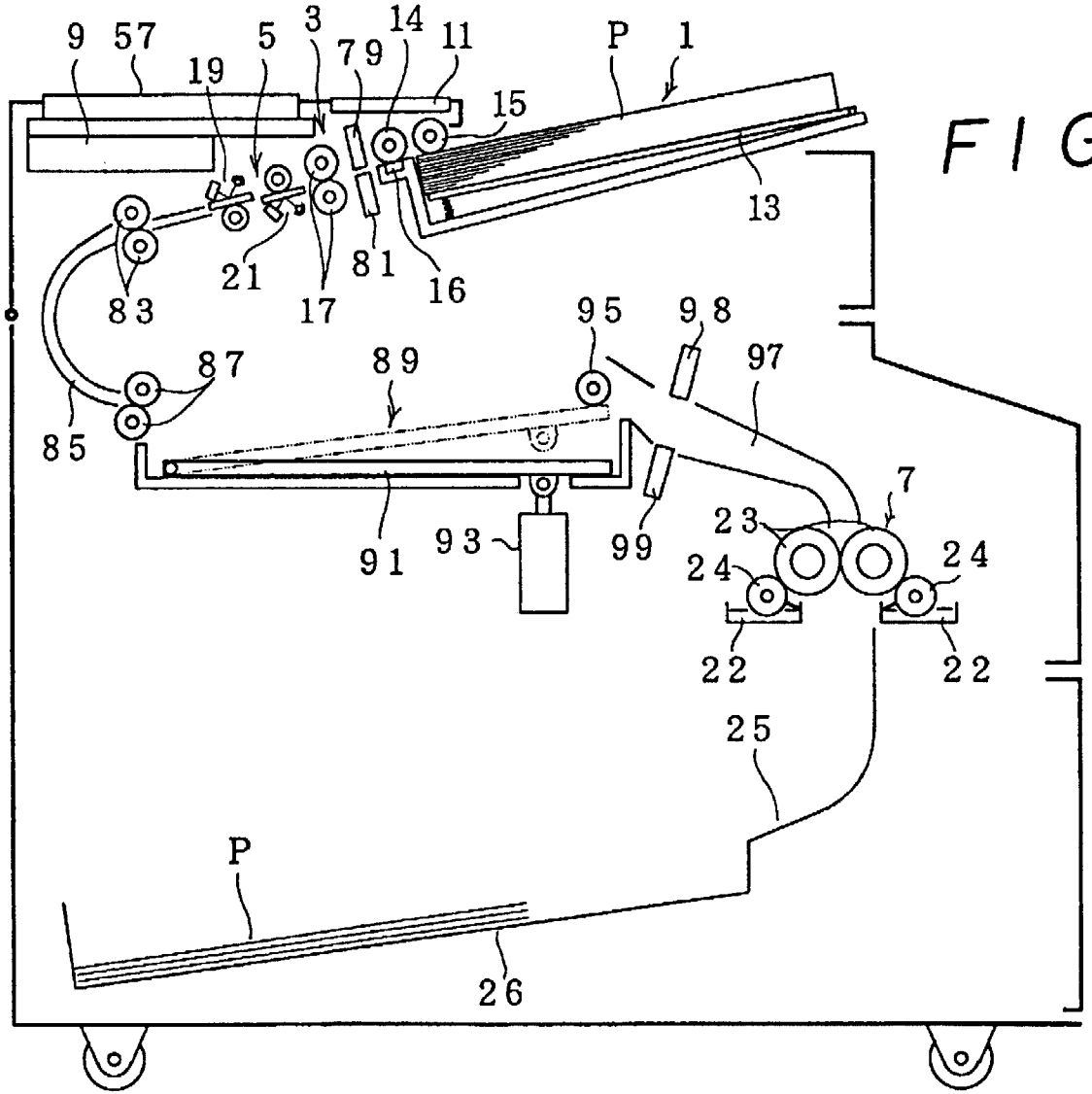
FIG. 9 is a schematic structural view of a fourth embodiment of the sheet printed information obliterating device according to the present invention.

FIG. 9 shows a fourth embodiment of the present invention. In FIG. 9, the parts corresponding to those illustrated in FIGS. 1 and 6 are denoted with like numerals as those used in FIGS. 1 and 6.

In this embodiment, the sheet printed information obliterating device is incorporated with a paper sheet storage unit 89, and a pair of rollers 83, a feed guide passage 85, and pair of feed rollers 87 for feeding the paper sheets P which have been passed through the information reading unit 5 to the paper sheet storage unit 89.

The paper sheet storage unit 89 comprises a moveable paper sheet receiving table 91, an actuator 93 for drivingly tilting the paper sheet receiving table, and a paper sheet fee out roller 95, and stacks up the paper sheets P which have been passed through the information reading unit onto the paper sheet receiving table 91 which is placed in its lowered positions as indicated by the solid line in the drawing.

The paper sheet receiving table 91 is placed in its lowered position by the actuator 93 when receiving paper sheets P, and in its lifted position indicated by the imaginary lines by the actuator 93 when feeding out the paper sheets P by pressing the paper sheets P against the paper sheet feed roller 95 disposed above the paper sheet receiving table 91.

The paper sheet feed out roller 95 feeds out the paper sheets pressed thereonto to the feed guide passage 97 and the information concealing printing unit 7 sheet by sheet.

The feeding of the paper sheets from the paper sheet storage unit 89 to the information concealing printing unit 7 may be started by pressing of an acknowledge key which may be provided on the operation panel 11 or by touching of an acknowledgment key of a touch panel 58 which may be provided in association with the display on the LCD panel 58 of the display unit 57. This operation is carried out when the pre-set count of the paper sheets as stacked on the paper feed table 13 and the actual count of the paper sheets actually read and displayed on the display panel 77 of the operation panel 11 or the display unit 57 match up with each other. If these two counts do not match up with each other, the feeding of the paper sheets P from the paper sheet storage unit 89 to the information concealing printing unit 7 is cancelled, and the user may take out the paper sheets P from the paper sheet storage unit 89, if necessary, to place them back again on the paper feed table 13 for restarting the process of reading information from the paper sheets.

Such a checking operation may be automatically carried out by entering the pre-set count of the paper sheets P stacked up on the paper feed table 13 in the information processing unit 9 prior to the process of reading information from the paper sheets P, and comparing the pre-set count entered in the information processing unit 9 with the automatically counted number of the paper sheets P actually read out.

As illustrated in FIG. 9, the outlet end of the paper sheet storing unit 89 is also provided with a double feed monitoring mechanism comprising a light emitting device 98 and a light receiving device 99 similar to the double feed monitoring mechanism consisting of the light receiving device 79 and the light receiving device 81 so that the occurrence of double feeding from the paper sheet storing unit 89 may be monitored, and an error process including the interruption of the system operation may be executed when an occurrence of double feeding is detected.

Figure 10:
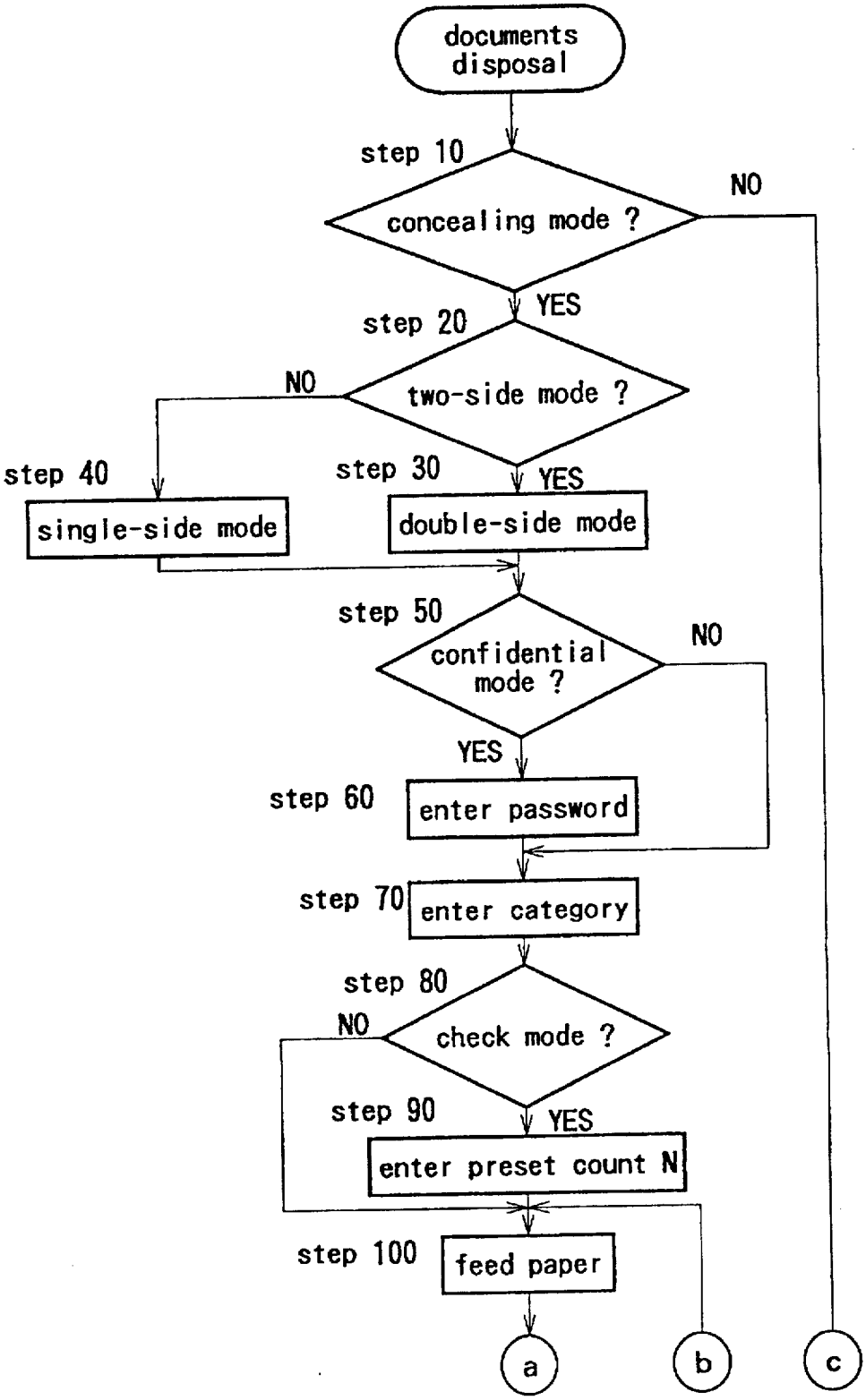
FIG. 10 is a flow chart showing an example of control flow for the sheet printed information obliterating device illustrated in FIG. 9 in regard to steps 10 through 100.
Figure 11:
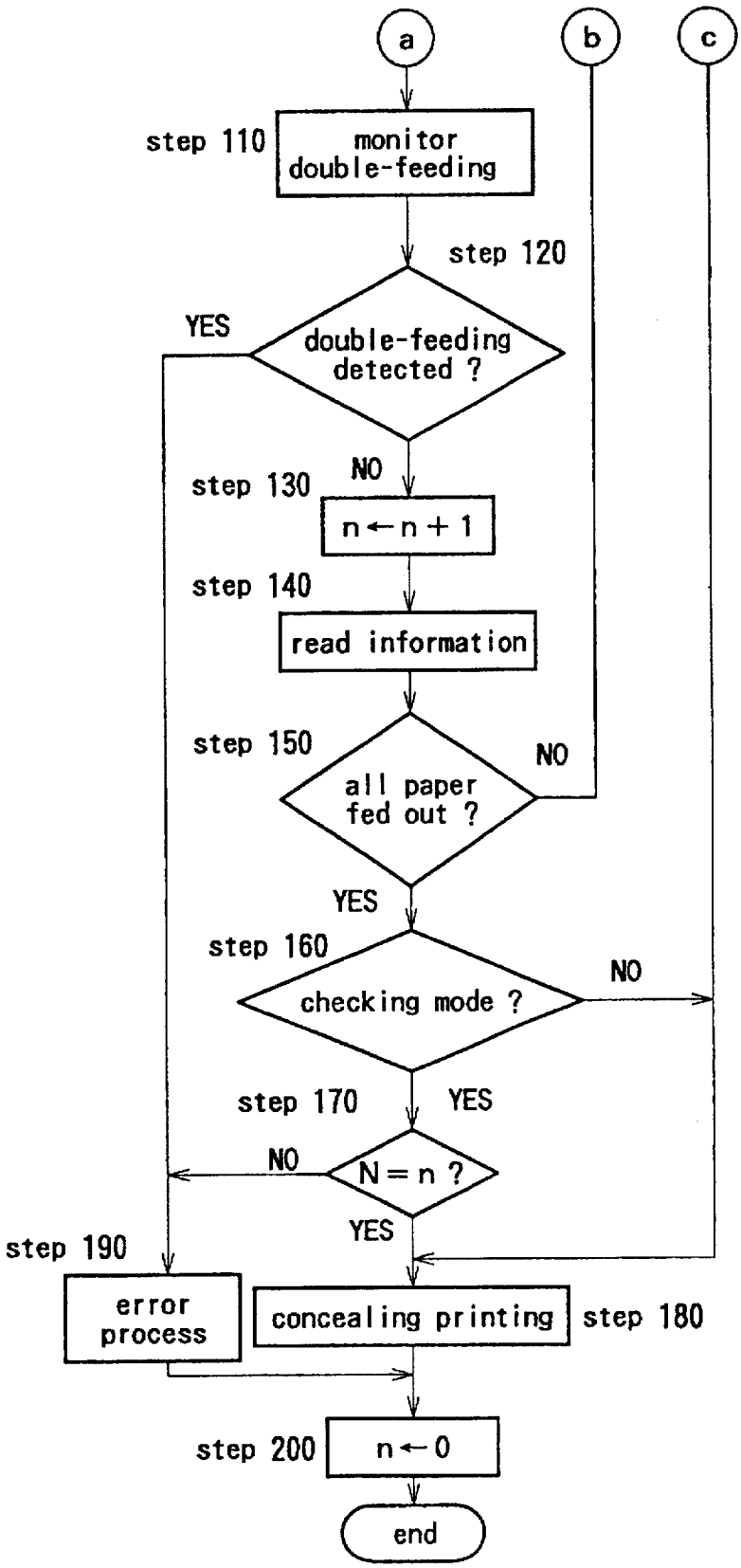
FIG. 11 is a flow chart showing an example of control flow for the sheet printed information obliterating device illustrated in FIG. 9 in regard to steps 110 through 200.

FIGS. 10 and 11 show a control flow of the sheet printed information obliterating device equipped with a structure for such an automatic checking mode. In this control flow, first of all, it is determined whether the storage mode or the concealing mode is selected (step 10). In case of the concealing mode, as there is no need to read and store information, the process of printing a concealing pattern over the paper sheet P is forthwith carried out by the information concealing printing unit 7 (step 180).

In case of the storage mode, it is determined whether the single side mode or the double side mode is selected (step 20). In case of the single side mode, the single side mode is set up so that the front side CCD line sensor 19 and the reverse side CCD line sensor 21 may be both activated (step 30). In case of the single side mode, the signal side mode is set up so that only the front side CCD line sensor 19 may be activated (step 40).

Then, it is determined if the confidential mode was selected (step 50), and, if so, the process of entering a password is executed before the program flow advances to the information category data input step (step 70). If the confidential mode is not selected, the program flow directly advances to the information category data input step (step 70).

Thereafter, it is determined if the checking mode is selected or not (step 80), and, if so, the process of inputting a pre-set count N of the paper sheets P placed on the paper feed table 13 is executed (step 90).

Then the setting up of the various modes is completed, the paper feed action is started (step 100), and the paper sheets are fed from the automatic paper feed unit 1 to the information reading unit 5 sheet by sheet while carrying out the monitoring of the occurrence of double feeding based on the detection of the amount of light received by the light receiving device (steps 110 and 120).

When an occurrence of double feeding is detected, the error processing including the interruption of the paper sheet feeding action is executed (step 190).

When no occurrence of double feeding is detected, the number n of the actually read paper sheets P is counted up (step 130), and the information is read out from each of the paper sheets P in the information reading unit 5 (step 140).

Then, it is determined whether all the paper sheets P placed on the paper feed table have been fed out (step 150), and if there are any paper sheets left on the paper feed table 13, the next paper sheet is fed out (step 100). If all the paper sheets P placed on the paper feed table 13 have been exhausted, it is determined if the checking mode has been selected (step 160).

If the checking mode has not been selected, the paper sheet storage unit 89 is forthwith made to feed out the paper sheets P to the information concealing printing unit 7 where the information concealing pattern is printed over the paper sheets P (step 180). On the other hand, if the checking mode has been selected, it is determined if the actual count n of the paper sheets matches with the pre-set count N of the paper sheets P (step 170).

If the actual count n of the read out paper sheets matches with the pre-set count N of the paper sheets P placed on the paper feed table 13 or, in other words, if it is determined that every paper sheet placed on the paper sheet table 13 has been properly read out, the paper sheet storing unit 89 is made to feed out the paper sheets to the information concealing printing unit 7 where an information concealing pattern is printed over the paper sheets P (step 180).

On the other hand, if the actual count n of the paper sheets which are read out does not match with the pre-set count N of the paper sheets, in particular if $n<N$, it means the occurrence of double feeding, and the error process is executed including the interruption of the feeding out of the paper sheets from the paper storing unit 89 to the information concealing printing unit 7 (step 190). Thus, the information concealment and discarding of the paper sheet from which information has not been read can be avoided.

The count n of the paper sheets which have been read out is reset to zero (step 200).

Figure 12:
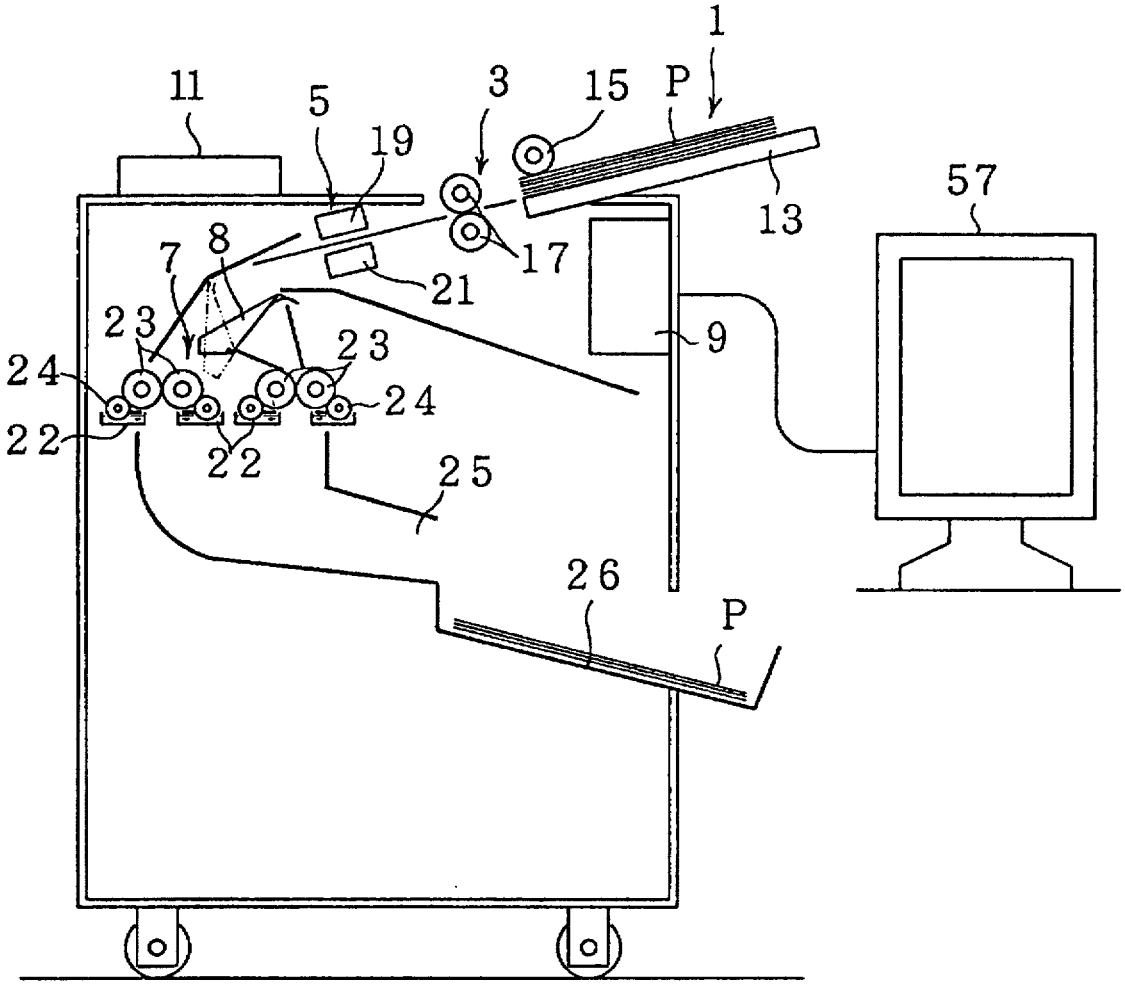
FIG. 12 is a schematic structural view of yet another embodiment of the sheet printed information obliterating device according to the present invention.

FIG. 12 shows a fifth embodiment of the sheet printed information obliterating device according to the present invention. In FIG. 12, the parts corresponding to those illustrated in FIG. 1 are denoted with like numerals as those used in FIG. 1. In this embodiment, the information concealing printing unit 7 is provided with two sets of printing rollers 23. For instance, one set of printing rollers 23 are adapted to print an information concealing pattern consisting of Japanese characters on the paper sheets P while the other set of printing rollers 23 are adapted to print an information concealing pattern consisting of English or Roman letters on the paper sheets P, and the paper sheets P can be selectively fed to either one of these two sets of printing rollers by switching over a gate member 8.

The switch over of the gate member 8 may be carried out by the operator depending on the kind of characters or letters used in each paper sheet to be disposed of.

The switch over of the gate member 8 may also be carried out automatically by automatically detecting the kind of letters or characters expressing the information according to the data on the image information obtained by the information reading unit 5.

As yet another embodiment of the sheet printed information obliterating device according to the present invention, a plurality of sets of printing rollers 23 may be provided in series in a passage for conveying the paper sheets in the information concealing printing unit 7 so that the printing of information concealing patterns may be carried out a plurality of times.

The information concealing printing unit 7 in the sheet printed information obliterating device is not limited to those using printing rollers 23 as described above, but may also consist of other types of printing devices including various printers such as wire dot printers, thermal transfer printers, and ink jet printers, electrophotographic printers such as laser beam printers, stencil printers and other printers, in addition to those employing rubber stamp rollers impregnated with stamp ink.

When various printers such as wire dot printers, thermal transfer printers, and ink jet printers, electrophotographic printers such as laser beam printers, stencil printers and other printers are used, a plurality of information concealing patterns may be stored in storage means, and they may be selectively used depending on the kind of letters expressing the information, the line pitch and the character pitch.

Figure 13:
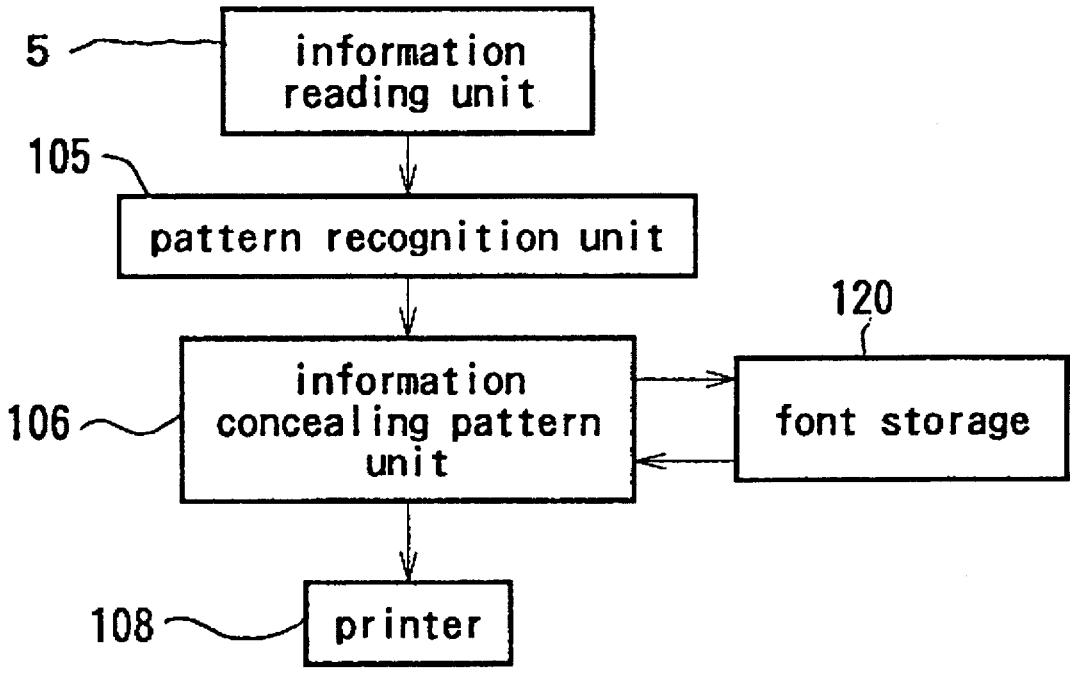
FIG. 13 is a block diagram showing a fifth embodiment of the sheet printed information obliterating device according to the present invention.

In such a case, as shown in FIG. 13, it is also possible to automatically distinguish and recognize the kind of letters and image patterns used in the paper sheet for expressing the information with a pattern recognition unit 105 according to the data obtained by the information reading unit 5, and to select an information concealing pattern with an information concealing pattern generating unit 106 from a font storage unit 120 according to the result of the distinguishing and recognition process by the pattern recognition unit 105 so that an optimum information concealing pattern may be selected according to the kind of letters expressing the information, the line pitch and the character pitch, and may be supplied to the printer 108.

The information concealing pattern may be changed randomly and electronically for each day or each time a new file is created by using a random number generator, and the analysis of the concealed information based on the knowledge of the information concealing pattern can be made difficult.

In any of the embodiments described above, the information concealing printing unit 7 is not limited to those for printing the pattern on both sides of each paper sheet, but may also consist of those capable of only printing an information concealing pattern on one side of each paper sheet or those capable of printing an information concealing pattern selectively either on one side or both sides of each paper sheet.

Again, in any of the above described embodiments, the reproduction of the image data stored in the information storing medium of the information storing medium unit 37 may be carried out not only by displaying it on a display unit but also by removing the information storing medium and using it on a floppy disk drive or an optical disk drive of a personal computer, an electronic filing system or other information processing device so that the image data stored in the information storing medium may be read out and displayed and/or printed by the personal computer, the electronic filing system or the like. Further, it is also possible to link up the sheet printed information obliterating device with a personal computer, an electronic filing system or other information processing device so that they may be able to communicate with each other, and to allow the image data stored in the information storing medium to be displayed and/or printed by using the personal computer, the electronic filing system or the like.

In the above described embodiments, the CCD line sensors were used as means for reading information, but the information reading means of the sheet printed information reading device according to the present invention may also consist of other optical reading devices such as contact type CCD sensors in addition to the CCD line sensors.

As can be understood from the above description, according to the printed information obliterating device of the present invention, because the information printed on the paper sheets or the like is rendered unreadable by printing an information concealing pattern over the information carrying surfaces of the paper sheets or the like to be disposed of by using information concealing printing means, the paper sheets or the like are not required to be shredded, and are allowed to retain their original condition. Therefore, the handling of the paper sheets to be disposed of is simplified, and the need for a large space or any substantial efforts is eliminated. Further, because the fibers of the paper sheets are not finely severed, and the processed paper can be easily recycled, wasting of available resources can be avoided. Furthermore, the printed information obliterating device of the present invention can operate quietly without generating substantially less noises as compared to the printed information obliterating device based on shredding of paper sheets.

Further, according to the printed information obliterating device of the present invention, since the information printed on the paper sheets or the like that are going to be disposed of is read out by the information reading means and is retrievably stored in the information storage means before the information concealing pattern is printed over the surface of each paper sheet, it is possible to reproduce the information carried by the paper sheets which have already been discarded.

Figure 14:
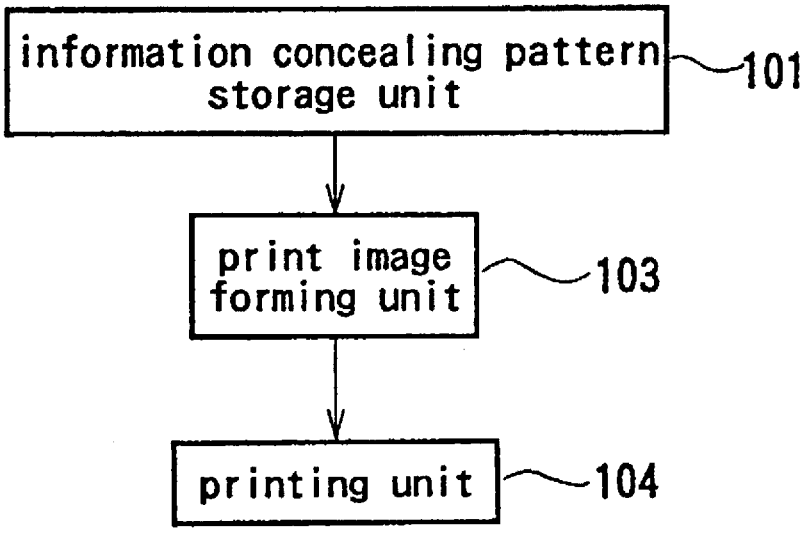
FIG. 14 is a block diagram showing the basic structure of a sixth embodiment of the sheet printed information obliterating device according to the present invention.

FIG. 14 shows a basic structure of a sixth embodiment of the sheet printed information obliterating device according to the present invention. The sheet printed information obliterating device comprises an information concealing pattern storage unit 101 storing sheet printed information concealing patterns, a print image forming unit 103 for forming a print image of each information concealing pattern stored in the information concealing pattern storage unit 101, and a printing unit 104 for printing the print image formed by the print image forming unit 103.

The printing system of this sheet printed information obliterating device may consist of a stencil printer, an electrographic printer, a wire dot printer, or an ink jet printer. When a stencil printer is used, the print image forming unit 103 and the printing unit 104 correspond to a master plate making unit and a printer unit of the stencil printer, respectively. When an electrographic printer is used, the print image forming unit 103 and the printing unit 104 corresponding to a electrostatic latent image forming unit for a photosensitive drum and a transfer unit for developing a toner image of the electrographic printer, respectively.

Figure 15:
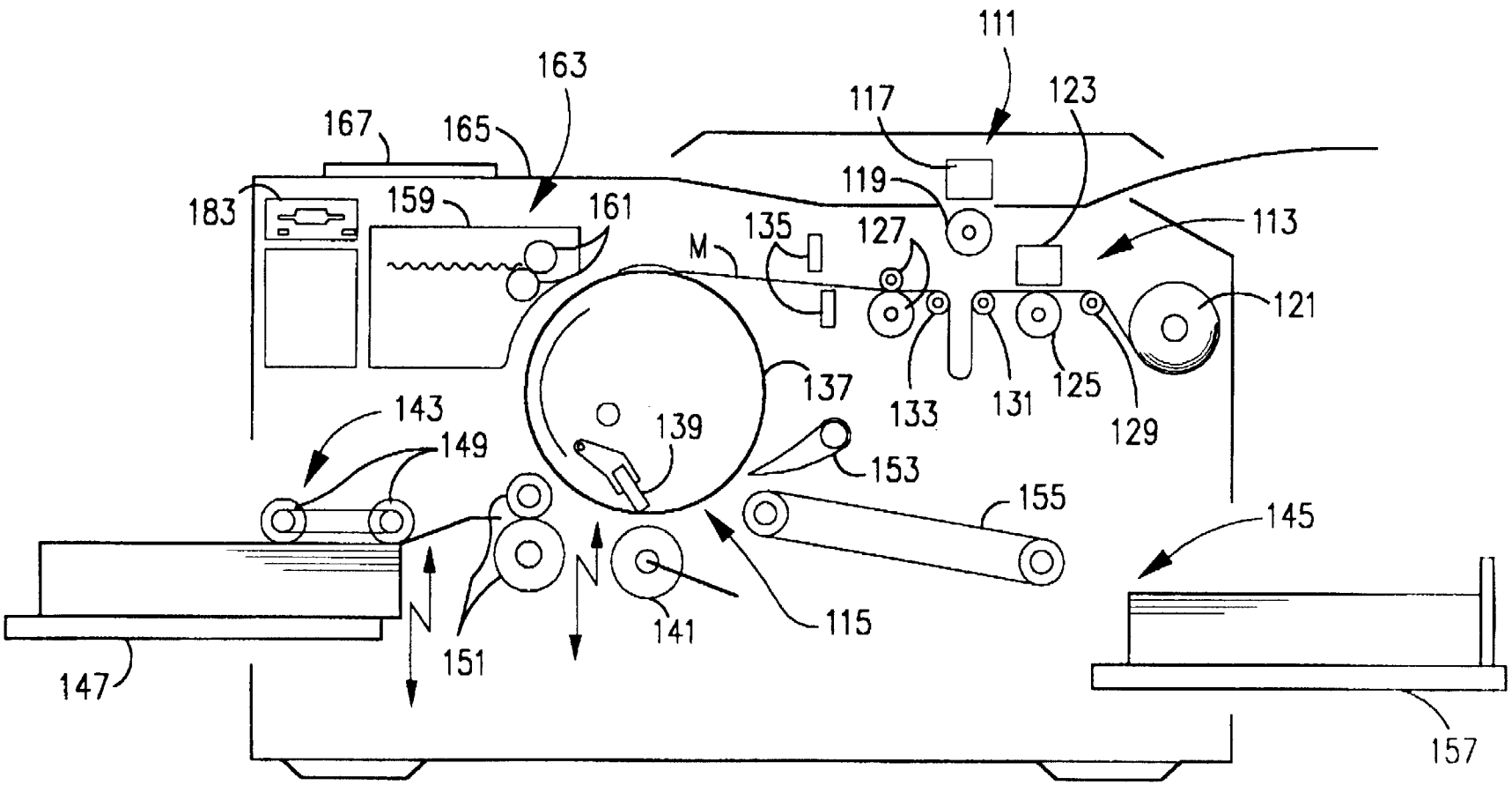
FIG. 15 is a schematic structural view showing the sixth embodiment of the sheet printed information obliterating device according to the present invention constructed as a digital master plate making type stencil printing device equipped with the function of concealing sheet printed information according to the present invention.

FIG. 15 shows more specifically the printer device equipped with a sheet printed information concealing function according to the present invention which is constructed as a digital master plate making type stencil printing device. This stencil printing device comprises an original reading unit 111, a master plate making unit 113, and a printer unit 115.

The original reading unit 111 consists of an image scanner, and is provided with a line image sensor 117 for reading the image of an original conveyed in a secondary scanning direction, and an original feed roller 119.

The master plate making unit 113 comprises a blank stencil master plate roller unit 121, a thermal head 123 comprising a plurality of dot shaped heat generating elements arranged in a lateral single row, blank stencil master plate feed rollers 125 and 127, blank stencil master plate guide rollers 129, 131 and 133, and a blank stencil master plate cutter 135, so that the heat sensitive blank stencil master plate M may be thermally perforated according to a dot matrix pattern, and the thus processed stencil master plate M may be severed by the cutter 135.

The printer unit 115 comprises a printing drum 137 which is perforated and ink permeable, an ink supply device 139 provided in the printing drum 137, and a press roller 141, and the processed stencil master plate M is wrapped around the outer circumferential surface of the printing drum 137.

A paper feed unit 143 is provided on one side of the printer unit 115, and a paper ejection unit 145 is provided on the other side of the printer unit 115.

The paper feed unit 143 comprises a paper feed table 147 for placing a stack of printing paper thereon, pick up rollers 149 for feeding the printing paper from the paper feed table 147 sheet by sheet, and timing rollers 151 for feeding each sheet of the printing paper to the nip between the printing drum 137 and the press roller 141.

The paper ejection unit 145 comprises a peeling claw 153 for peeling the printed paper sheet from the printing drum 137, a paper ejection belt unit 155, and a paper ejection table 157 for placing a stack of printed paper thereon.

On the other side of the printer unit 115 is provided a master plate ejection unit 163 including a master plate ejection roller 161 for peeling the used stencil master plate M from the printing drum 137 and conveying it to an ejection master plate box 159.

The stencil printing device comprises an operation panel 167 mounted on an upper surface of its outer case 165, and the operation panel 167 is provided with keys for setting various operation modes and the number of printed copies, and a display unit consisting, for instance, of an LCD panel for displaying the procedure of operation and the condition of the device.

Figure 16:
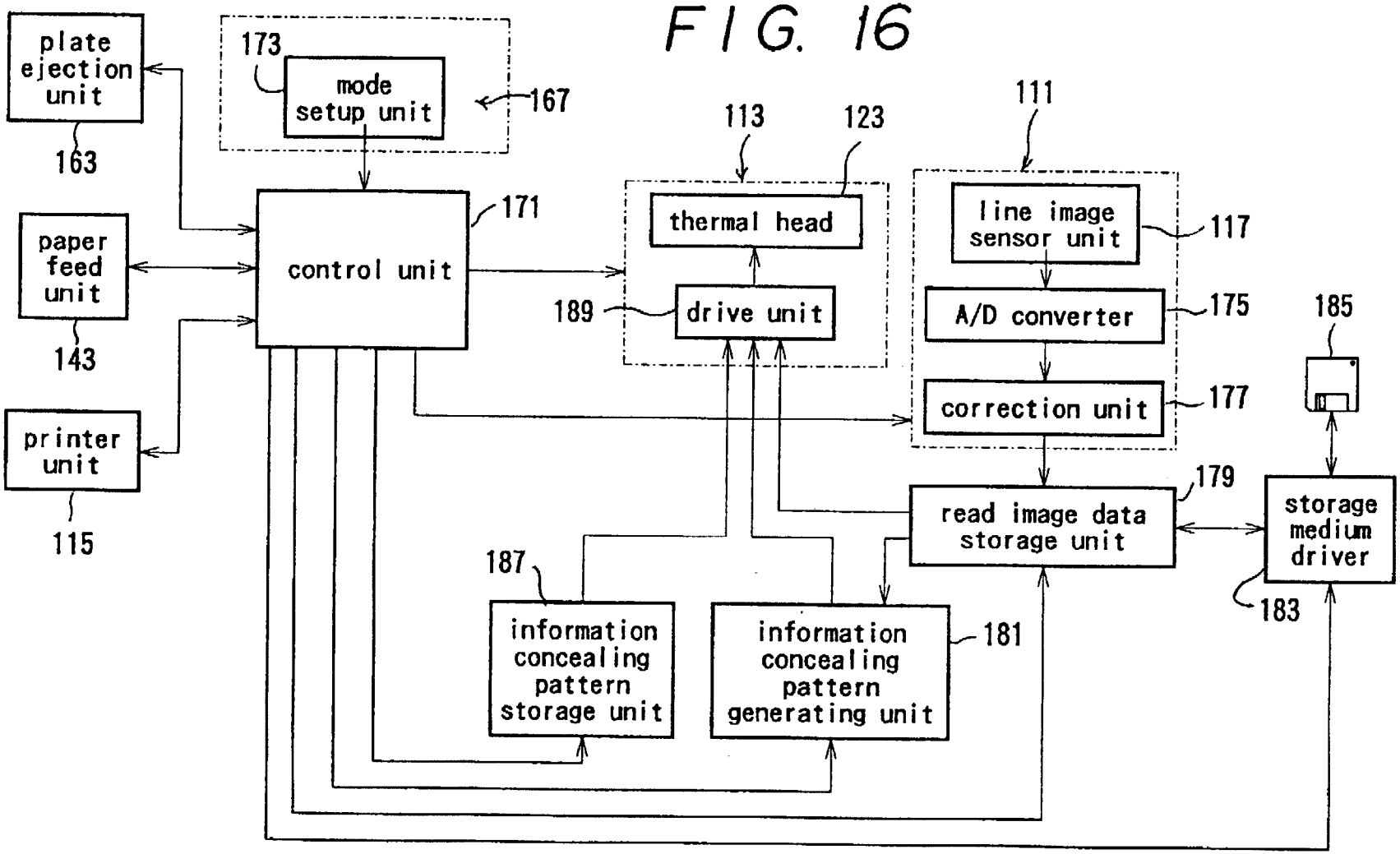
FIG. 16 is a block diagram showing an embodiment of the control system for the digital master plate making type stencil printing device equipped with the function of concealing sheet printed information shown in FIG. 15.

FIG. 16 shows an embodiment of the control system for such a digital master plate making type stencil printing device. This control system comprises a control unit 171 for controlling the overall action of the printing device. The control unit 171 is based on the principle of a micro computer including a CPU, and by receiving command signals from the operation panel 167 controls the operation of the original reading unit 111, a master plate making unit 113, a printer unit 115, a paper feed unit 143, and a master plate ejection unit 163 according to a prescribed program.

The operation panel 167 comprises a mode setup unit 173 using mode setup keys which can selectively set up a normal plate making/printing mode, an information concealing mode, a recording mode, and reproducing mode.

The original reading unit 111 comprises an A/D converter unit 175 for converting the (analog) signal obtained by reading the original with the line image sensor 117, and a correction unit 175 for receiving a digital signal or a read image data and conducting a shooting correction and a gamma correction, and the read and corrected image data is stored in an image data storage unit 179 for each page of the original.

The read image data stored in the read image data storage unit 179 is supplied to the master plate making unit 113 in the normal plate making/printing mode, to an information concealing pattern generating unit 181 in the concealing mode, and to a storing medium driver 183 in the recording mode by the command from the control unit 171.

The recording medium driver 183 may consist of a floppy disk drive, and can removeably take a floppy disk 185 for writing print image data thereinto, and reading print image data therefrom. The recording medium driver 183 may consist of not only a floppy disk driver but also a magnetic hard disk drive, an optical magnetic disk driver or the like.

The information concealing pattern generating unit 181 automatically generates an information concealing pattern which is to be printed over the information carrying surfaces of paper sheets according to the read image data received from the read image data recording unit 179 according to the command signal from the control unit 171, and can automatically generate an optimum information concealing pattern which makes the printed information most unreadable by being printed thereon according to the information layout pattern, the kind of letters, the line spacing, the character pitch and other factors. The image data of the information concealing pattern is supplied to the master plate making unit 113 as data on one of the print images.

The master plate making unit 113 also receives image data for an information concealing pattern from the information concealing pattern storage unit 187. The information concealing pattern storage unit 187 comprises ROM which stores image data on a plurality of information concealing patterns, and supplies image data for a selected one of the information concealing patterns as print image data according to the command signal from the control unit 171.

The information concealing patterns stored in the information concealing pattern storage unit 187 may consist of patterns which are capable of rendering the character and other information printed on a sheet of paper or the like unreadable by being printed thereover, such as solid patterns, halftone patters, fine geometric patterns, irregular dot patterns, irregular stripe patters, characters or letters having a substantially same size as the characters, letters and symbols that are to be concealed and consisting of a large number of lines arranged at a dense character pitch and line spacing. The optimum information concealing pattern may vary depending on the way the information is printed on the paper sheet, the printing material such as ink or the toner, and other factors, but irregular stripe patterns and character patterns generally produce good results. The characters or letters which may be used as the information concealing pattern are preferred to be of the same kind as the carrier of the information. For instance, when the information to be concealed is expressed in Japanese, Japanese characters and letters or, in other words, katakanas, hiraganas, and kanjis are preferred. When the information to be concealed is expressed in English, Roman letters are preferred as the patterns for concealing the information. The information concealing pattern may consist of a repetition of a same letter or may consist of a periodic or irregular repetition of a plurality of letters, or may even consist of letters forming meaningful sentences.

The master plate making unit 113 comprises a driver unit 189 for individually controlling each heat generating element of the thermal head 123, and the driver unit 189 receives print image data from the read image data storage unit 179, the information concealing pattern generating unit 181, and the information concealing pattern storage unit 187 so that the dot-shaped heat generating elements of the thermal head 123 may be selectively heated up according to the print image data supplied thereto, and a master plate may be produced by thermal perforation of the blank stencil master plate M in the manner of a dot-matrix according to the input print image data.

Figure 17:
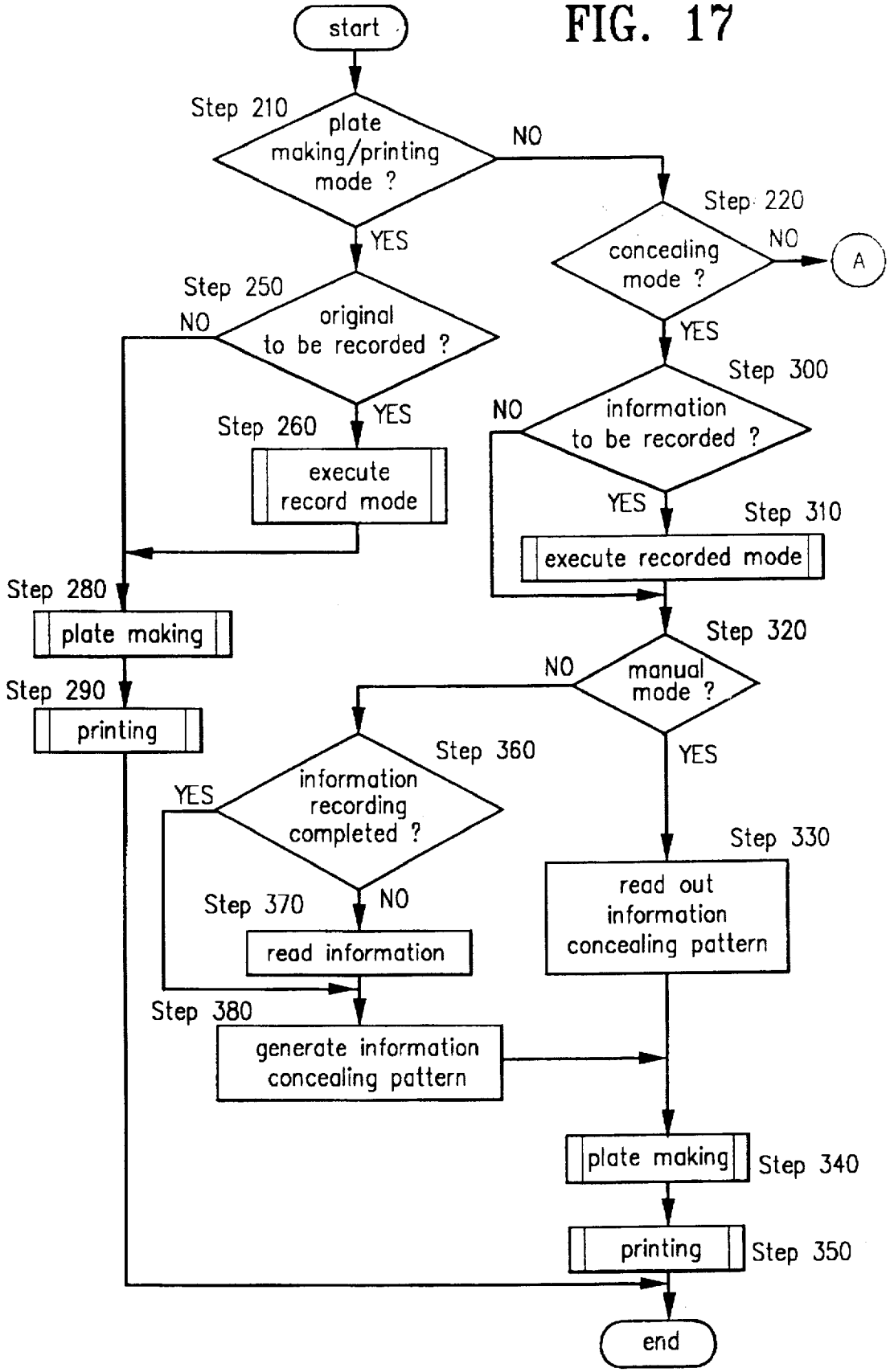
FIG. 17 is a flow chart showing steps 210, 220, 250 through 350 of the operation flow of the digital master plate making type stencil printing device equipped with the function of concealing sheet printed information shown in FIG. 15.
Figure 18:
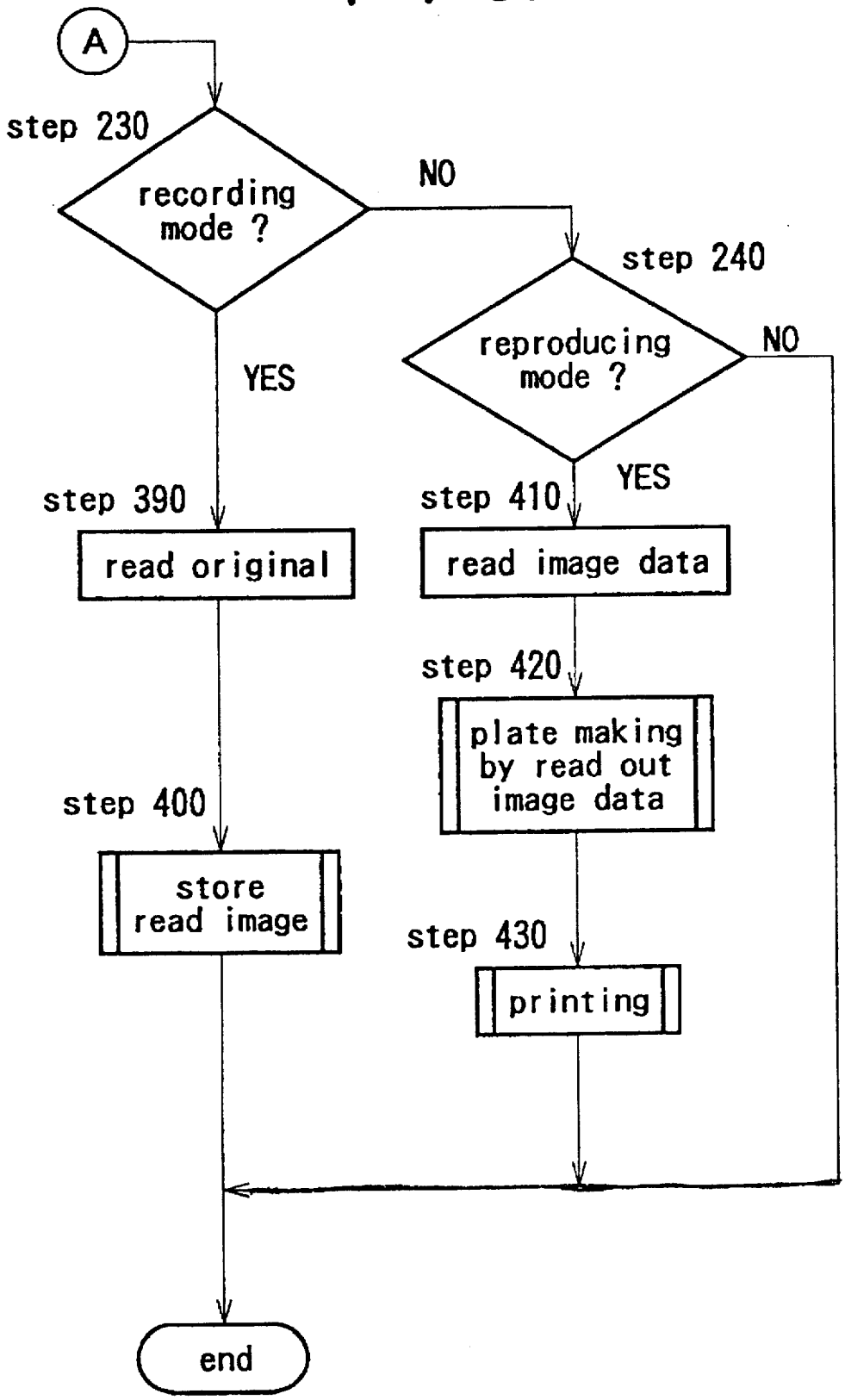
FIG. 18 is a flow chart showing steps 230, 240, 390 through 430 of the operation flow of the digital master plate making type stencil printing device equipped with the function of concealing sheet printed information shown in FIG. 15.

Now the operation flow of the digital master plate making type stencil printing device having the above described structure is described in the following with reference to FIGS. 17 and 18. First of all, an operation mode is selected by the user according to a signal from the mode setup unit 173 (steps 10 through 40).

In the case of normal master plate making printing mode ("yes" in step 210), it is determined if the recording of the original is required (step 250). This choice is left for the user to decide. When the original is needed to be recorded, a recording mode which is described hereinafter is executed when reading the original image by the original reading unit 11 (step 260), and the process of making a master plate is then started (step 280). If the original is not required to be recorded, the process of making a master plate is started at once (step 280).

In this plate making process, the original image to be printed is read by the original reading unit 11, and the read original image is supplied to the plate making unit 13 as data on the print image which is then reproduced on a blank stencil master plate in the plate making unit 13.

When the process of making a master plate is completed, a printing process is started (step 290).

In the printing process, the used stencil master plate M mounted on the printing drum 137 is removed therefrom, and a processed new stencil master plate M is mounted on the outer circumferential surface of the printing drum 137. The printing drum 137 is rotatively driven while the press roller 141 is vertically actuated in synchronism with the rotation of the printing drum. The paper feed unit 143 and the paper ejection belt unit 155 are also driven in synchronism with the rotation of the printing drum 137.

Thus, the printing paper stacked on the paper feed table 147 is taken out sheet by sheet by the pick up roller 149, and is supplied to the timing roller 151. The printing paper is further fed to the nip between the printing drum 137 and the press roller 141 by the timing roller 151, and a print image corresponding to the read original image is formed on the upper surface of the printing paper as a process of stencil printing. The printed printing paper is removed from the printing drum 137 by a peeling claw 153 of the paper ejection unit 145, and is conveyed to the paper ejection table 157 by the paper ejection belt unit 155 to be eventually stacked on the paper ejection table 157.

In the concealing mode ("yes" in step 220), it is determined if the information carried by the paper sheet to be processed is needed to be recorded (step 300). This is one of the items decided by the user, and the information is needed to be recorded the recording mode which is described hereinafter is executed (step 310). In this case, the paper sheet from which image is to be read is a paper sheet from which information is to be concealed, and the information carried by the information carrying surface of the paper sheet is read.

It is then determined if the concealing pattern setup mode is set to a manual setup mode or not (step 320). If the concealing pattern setup mode is set to the manual setup mode, image data on a manually selected one of the information concealing patterns is read out from the information concealing pattern storage unit 187, and transfers it to the master plate making unit 13 (step 330). Thereby, the master plate making unit 13 makes a master stencil plate carrying a print image of the information concealing pattern corresponding to the image data read out from the information concealing pattern storage unit 187 (step 340). When the master plate is made, the printing process is started (step 350).

On the other hand, when the information concealing mode is not set to the manual setup mode but to the automatic setup mode, it is then determined if the reading of the information has been completed or not (step 360). This determination process amounts to the determination of if step 310 has been executed or not. If step 310 has been executed, as it means that the information carried by the paper sheet which is needed to be concealed, step 310 is executed. If step 310 has not been executed, and the information carried by the paper sheet has not been read, the information is read by the original information reading unit 11 (step 370), and after the information has been read step 380 is executed.

In step 380, an optimum information concealing pattern for concealing the particular information is automatically generated by the information pattern generating unit 181 according to the image data obtained from the information carrying surface of the paper sheet, and this data is supplied data of a print image to the master plate making unit 13. Thereby, the master plate making unit 13 makes a master stencil plate carrying a print image of the information concealing pattern corresponding to the image data generated from the information concealing pattern generating unit 181 (step 340). When the master plate is made, the printing process is started (step 350).

The printing process in step 350 is carried out in a similar way as the printing process in step 290. In this case, the paper sheets which are required to be disposed of are stacked on the paper feed table 147 instead of the printing paper sheets. Thus, the information concealing pattern is printed over the information carrying surface of each of the paper sheets by stencil printing, and the information covered by the information concealing pattern is rendered unreadable.

In the recording mode ("yes" in step 230), the image is read from the original by the original image reading unit 11 (step 390). The reading of image by the original image reading unit is conducted on an original for printing or to a paper sheet carrying the information to be concealed. The image data of the image read by the original reading unit 11 is supplied to the read image data storage unit 179, and is then supplied to the floppy disk drive 185 to be written into a storage medium, in this case consisting of a floppy disk, by way of the storage medium driver 183 (step 400).

In the reproducing mode ("yes" in step 240), image data stored in the floppy disk 185 is read out to the read image data storage unit 179 with the storage medium driver 183 (step 410), this image data is supplied to the master plate making unit 13 as data of one print image. The master plate making unit 13 then forms the print image according to the read image data obtained from the read image data storage unit 179 (step 420). When this master plate making process is completed, the printing process is started (step 430). The printing process in step 430 is similar to the printing process in step 290, and the printing process based on the read image data is conducted on the printing paper.

The reproducing mode may be prohibited to non-authorized users by using a password.

The determination of the information concealing pattern by the manual setup mode can be made electronically by using a random number generator, and may be changed each day or each time a new file is created. By doing so, the reading of the information by analyzing the information concealing pattern can be made even more difficult. The information concealing pattern may be prepared by composing the data from the information concealing pattern generating unit 181 and the information concealing pattern storage unit 187.

The information concealing pattern generated by the information concealing pattern generating unit 181 can be stored in the storage medium so as to be read out as required for repeated use.

In the above described embodiments, the printing device equipped with the function of concealing information carried by sheets of paper or the like was applied to a digital master plate making type stencil printing device, but the printing device equipped with the function of concealing information carried by sheets of paper or the like according to the present invention can be equally applied to electrographic digital copiers, laser beam printers, wire dot printers, and ink jet printers.

As can be understood from the above description, according to the device for concealing information carried by sheets of paper or the like and the printing device therefor, because the information concealing pattern is printed over the information carried by the sheet of paper or the like so as to render the information unreadable, the sheets of paper or the like are not shredded and can retain their original condition, the handling of the sheets to be disposed of is simplified without requiring any large space or excessive efforts. And, since the fibers of the paper sheets are not finely severed, the processed paper sheets can be recycled, and the waste of available resources can be avoided.

Although the present invention has been described in terms of specific embodiments thereof, it is possible to modify and alter details thereof without departing from the spirit of the present invention.

What we claim is:

1. An apparatus for obliterating printed information on a surface of a sheet material comprising:

an information concealing printing device for printing an information concealing pattern over said surface of said sheet carrying said printed information;

an information reading device for reading information printed on said information carrying surface of said sheet before said information concealing printing device prints said information concealing pattern over said information carrying surface of said sheet;

an information storage device for retrievably storing data representing said information read by said information reading device;

a pattern recognition device for automatically recognizing a kind of said information printed on said information carrying surface of said sheet according to data obtained by said information reading device;

an information concealing pattern storage device for storing pattern data; and an image forming device for generating said information concealing pattern according to pattern data and for supplying said information concealing pattern to said information concealing printing device;

wherein the information concealing pattern generated by said image forming device is automatically selected according to a result of said recognition process by said pattern recognition device.

2. An apparatus as in claim 1, further comprising a mode setting device, for selectively setting an information concealing mode, and a normal print image storage device for storing images for a normal printing purpose, said information concealing printing device printing said information concealing pattern on said information carrying surface of said sheet when said information concealing mode is set up by said mode setting device, and printing normal print images on a surface of a sheet when a mode different from said information concealing mode is set up by said mode setting device.

3. An apparatus as in claim 2, wherein said images for normal printing purpose are derived from a substantially permanent data storage device.

4. An apparatus as in claim 2, wherein said images for a normal printing purpose are derived from images obtained by an image scanning device.

5. An apparatus as in claim 1 wherein said sheet carries said printed information on opposite surfaces thereof and said information concealing printing device prints an information concealing pattern on said opposite surfaces of said sheet.

6. An apparatus as in claim 5 wherein said information reading device reads said information carried on opposite surfaces of said sheet.

7. An apparatus as in claim 1 further comprising means for selectively enabling and disabling said information reading device and said information storage device to thereby selectively control the storage of data representing said information read by said reading device in said storage device.

8. An apparatus as in claim 7 wherein said means for selectively enabling and disabling includes an operator actuatable device for inputting an indication of whether said printed information on said sheet is to be stored.

9. An apparatus as in claim 7 wherein said means for selectively enabling and disabling includes a means for sensing a code on said sheet which indicates whether said printed information on said sheet is to be stored.

10. An apparatus as in claim 1 further comprising a means for changing said information concealing pattern.

11. An apparatus is in claim 10 wherein said means for changing changes said information concealing pattern in a random manner.

12. An apparatus as in claim 1 wherein said information concealing pattern storage device further comprises a device for substantially permanently storing said information concealing pattern.

13. An apparatus as in claim 1 further comprising a font storage device for storing fonts therein and wherein said information concealing pattern uses a font automatically selected from said font storage device.

* * * * *